US009025021B2

(12) United States Patent
Aman

(10) Patent No.: US 9,025,021 B2
(45) Date of Patent: May 5, 2015

(54) SYSTEM AND METHODS FOR TRANSLATING SPORTS TRACKING DATA INTO STATISTICS AND PERFORMANCE MEASUREMENTS

(75) Inventor: James A. Aman, Telford, PA (US)

(73) Assignee: Intheplay, Inc., Lansdale, PA (US)

( * ) Notice: Subject to any disclaimer, the term of this patent is extended or adjusted under 35 U.S.C. 154(b) by 1404 days.

(21) Appl. No.: 12/438,613

(22) PCT Filed: Sep. 11, 2007

(86) PCT No.: PCT/US2007/019725

§ 371 (c)(1),
(2), (4) Date: Feb. 5, 2010

(87) PCT Pub. No.: WO2008/033338

PCT Pub. Date: Mar. 20, 2008

(65) Prior Publication Data

US 2010/0134614 A1 Jun. 3, 2010

Related U.S. Application Data

(60) Provisional application No. 60/843,677, filed on Sep. 11, 2006.

(51) Int. Cl.

| | |
|---|---|
| ***H04N 7/18*** | (2006.01) |
| ***A63B 71/06*** | (2006.01) |
| ***A63B 24/00*** | (2006.01) |

(52) U.S. Cl.

CPC ..... *A63B 71/06* (2013.01); *A63B 24/0003* (2013.01); *A63B 24/0021* (2013.01); *A63B 2024/0025* (2013.01); *A63B 2024/0028* (2013.01); *A63B 2024/0031* (2013.01); *A63B 2024/0056* (2013.01); *A63B 2220/30* (2013.01);

(Continued)

(58) Field of Classification Search

USPC ..... 348/135

See application file for complete search history.

(56) References Cited

U.S. PATENT DOCUMENTS

| | | | |
|---|---|---|---|
| 6,270,433 | B1 | 8/2001 | Orenstein et al. |
| 6,567,116 | B1 | 5/2003 | Aman et al. |
| 6,707,487 | B1 * | 3/2004 | Aman et al. ..... 348/169 |
| 6,725,107 | B2 | 4/2004 | MacPherson |

(Continued)

OTHER PUBLICATIONS

International Search Report dated Feb. 29, 2008.

*Primary Examiner* — Richard Torrente

(74) *Attorney, Agent, or Firm* — Stradley Ronon Stevens & Young, LLP

(57) ABSTRACT

A system for creating objective sports measurements and statistics of a sporting event. The system analyzes the continuous on-going motion of the players, the game object and the state of the game. Continuous on-going motion of the players and game object can be obtained through any of several technologies including cameras, IR sensors, RFID, etc. The state of the game includes at least the determination of when the competition is officially on versus paused. For sports that include a game clock, the detection of a running clock indicates that the competition is on, whereas a stopped clock indicates that the competition is paused. The combination of these three data sets, i.e., player locations, game object locations and the state of the game, are both necessary and sufficient for objectively determining key sports metrics including when the game object is in possession of a given player, which expands into the cycle of possession flow.

16 Claims, 20 Drawing Sheets

(52) U.S. Cl.
CPC ..... *A63B 2220/40* (2013.01); *A63B 2220/806* (2013.01); *A63B 2220/836* (2013.01); *A63B 2225/20* (2013.01); *A63B 2243/0004* (2013.01); *A63B 2243/0025* (2013.01); *A63B 2243/0037* (2013.01); *A63B 2243/0045* (2013.01); *A63B 2243/007* (2013.01); *A63B 2243/0075* (2013.01); *A63B 2243/0083* (2013.01)

(56) References Cited

U.S. PATENT DOCUMENTS

| | | | | |
|---|---|---|---|---|
| 2003/0049590 | A1* | 3/2003 | Feldbau | 434/251 |
| 2004/0194129 | A1* | 9/2004 | Carlbom et al. | 725/32 |
| 2005/0070349 | A1* | 3/2005 | Kimura | 463/4 |

* cited by examiner

*Fig. 1*

300

| | Ice Time | Chances | Shots On Net | Goals | Face-Offs Won | Face-Offs Lost | Penalty Minutes | Turnovers | Plus-Minus |
|---|---|---|---|---|---|---|---|---|---|
| **Who** | | | | | | | | | |
| Per Player | ✓ | ✓ | ✓ | ✓ | ✓ | ✓ | ✓ | ✓ | ✓ |
| Per Line | ✓ | ✓ | ✓ | ✓ | ✓ | ✓ | ✓ | ✓ | ✓ |
| Per Team | ✓ | ✓ | ✓ | ✓ | ✓ | ✓ | ✓ | ✓ | ✓ |
| **What** | | | | | | | | | |
| Even Strength | ✓ | ✓ | ✓ | ✓ | ✓ | ✓ | ✓ | ✓ | |
| Power Play | ✓ | ✓ | ✓ | ✓ | ✓ | ✓ | ✓ | ✓ | |
| Short Handed | ✓ | ✓ | ✓ | ✓ | ✓ | ✓ | ✓ | ✓ | |
| **Where** | | | | | | | | | |
| Attack Zone | ✓ | ✓ | ✓ | ✓ | ✓ | ✓ | ✓ | ✓ | |
| Neutral Zone | ✓ | ✓ | ✓ | ✓ | ✓ | ✓ | ✓ | ✓ | |
| Defensive Zone | ✓ | ✓ | ✓ | ✓ | ✓ | ✓ | ✓ | ✓ | |
| **When** | | | | | | | | | |
| Per Shift | ✓ | ✓ | ✓ | ✓ | ✓ | ✓ | ✓ | ✓ | |
| Per Period | ✓ | ✓ | ✓ | ✓ | ✓ | ✓ | ✓ | ✓ | ✓ |
| Per Game | ✓ | ✓ | ✓ | ✓ | ✓ | ✓ | ✓ | ✓ | ✓ |

Gaining Control
Relinquishing Control
3a
Face-Off
3b
Loose Puck
(clear, dump
or rebound)
3c
Pass from
Teammate
3d
Take-Away
(caused by
Player)
3e
Give-Away
(caused by
Teammate)
4
Possession
(Touch or Carry)
Period Ends
/ Penalty
3f
Loose Puck
(clear or dump)
3g
Scoring
Attempt
3h
Pass to
Teammate
3i
Take-Away
(caused by
Opponent)
3j
Give-Away
(caused by
Player)
3k

*Fig. 4b*

| | Possession Flow Events | | | | | | | | | | | | | | | | |
|---|---|---|---|---|---|---|---|---|---|---|---|---|---|---|---|---|---|
| | Gain Control (210) | | | | Exchange Control (220) | | | | | | | Relinquish Control (230) | | | | | |
| | Win Face-Off (3a) | Take-Away (3d) | Give-Away (3e) | Loose Puck (3b) | Clear / Pick up (3e-1) | Dump / Pick up (3e-2) | Area Pass / Pick up (3e-3) | Area Pass / Pick up (3e-3) | Area Pass / Pick up (3e-3) | Drop Pass / Pick Up (3e-4) | Pass / Catch (3e-5) | Period Ends (3f) | Take-Away (3i) | Give-Away (3k) | Scoring Attempt (3h) | Clear or Dump (3g) | Clear or Dump (3g) |
| 150 Clock States | | | | | | | | | | | | | | | | | |
| 151 Time is Out | 1 | | | | | | | | | | | 2 | | | | | |
| 152 Time is In | 2 | 1 | 1 | 1 | 1 | 1 | 1 | 1 | 1 | 1 | 1 | 1 | 1 | 1 | 1 | 1 | 1 |
| 160 Puck Movement States | | | | | | | | | | | | | | | | | |
| 161 Free | | | 2 | 2 | 2 | 2 | 2 | 2 | 2 | 2 | 2 | 1 | | 2 | 2 | 2 | 2 |
| 162 Under Contention | 2 | 2 | | | | | | | | | | 1 | 2 | | | | |
| 163 In Possession of Home Team | 3 | 3 | 3 | 3 | 1, 3 | 1, 3 | 1, 3 | 1, 3 | 1, 3 | 1, 3 | 1, 3 | 1 | 1 | 1 | 1 | 1 | 1 |
| 164 In Possession of Away Team | | 1 | 1 | 1 | | | | | | | | | 3 | 3 | | 3 | 3 |
| 170 Puck Zone Locations | | | | | | | | | | | | | | | | | |
| 171 Defensive Zone | | | | | F | | F-T | T | | | | | | | F | F | |
| 172 Neutral Zone | | | | | T | F | F-T | F | T | | | | | | F | T | F |
| 173 Attack Zone | | | | | T | T | F-T | | F | | | | | | F | | T |
| 180 Puck Heading Directions | | | | | | | | | | | | | | | | | |
| 181 Teammate not-directly behind player | | | | | | | | | | | P | | | | | | |
| 182 Teammate directly behind player | | | | | | | | | | P | | | | | | | |
| 183 Opponent | | | | | | | | | | | | | | | | | |
| 184 Open Ice | | | | | P | P | P | P | P | | | | | | | | |
| 185 Oppenent's Goal | | | | | | | | | | | | | | | P | | |

*Fig. 5c*
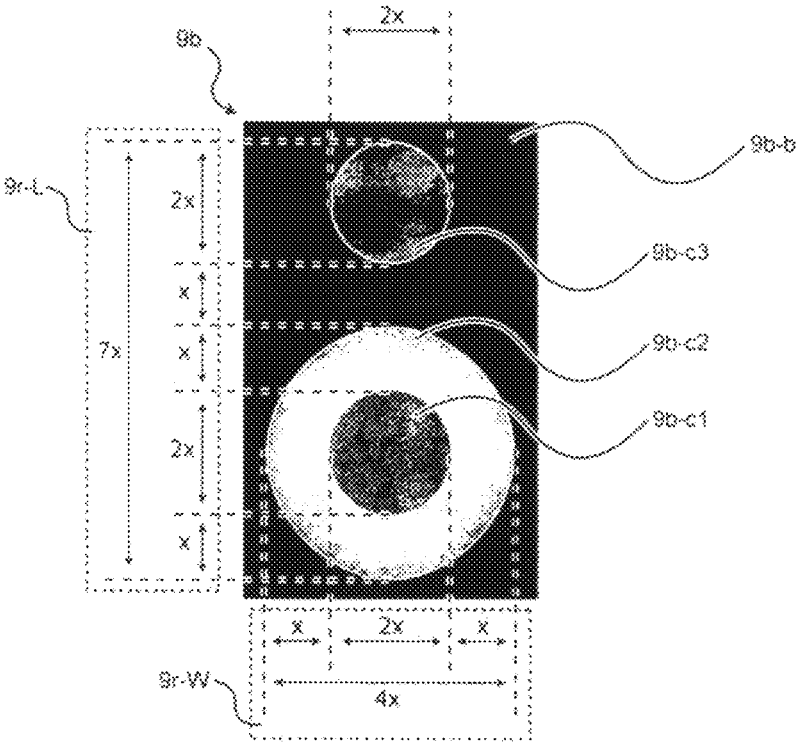
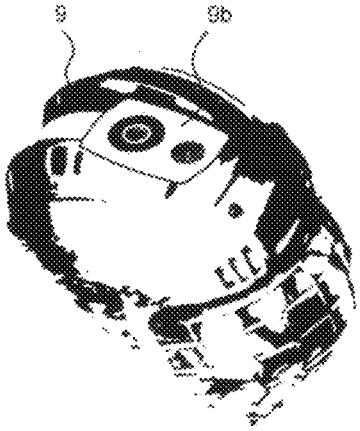
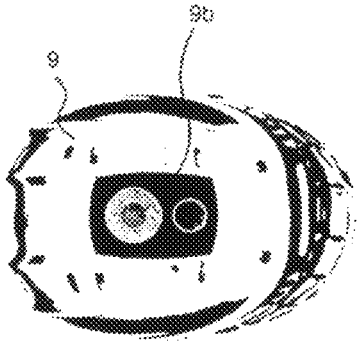

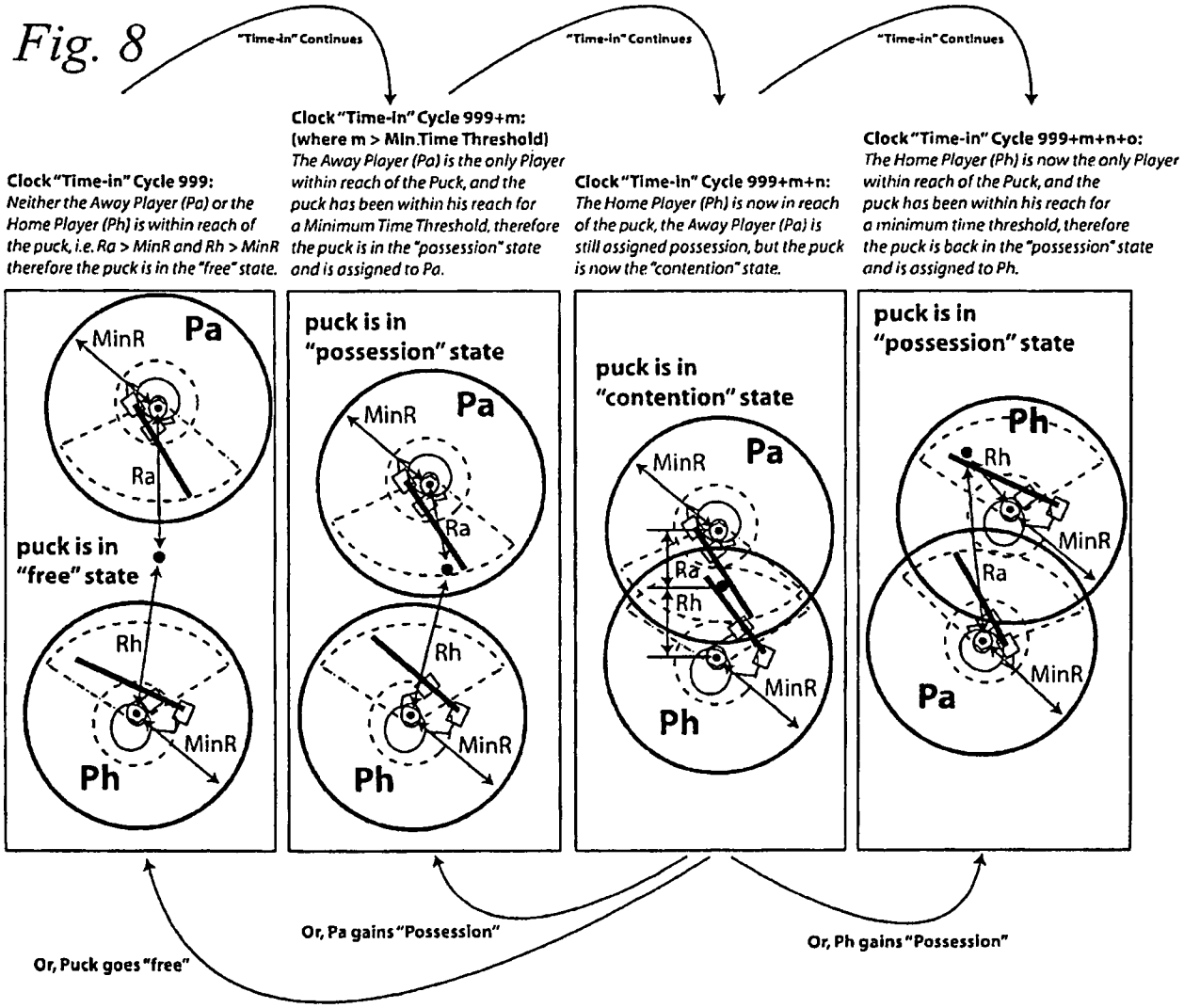
Fig. 8
"Time-in" Continues
Clock "Time-in" Cycle 999:
Neither the Away Player (Pa) or the Home Player (Ph) is within reach of the puck, i.e. Ra > MinR and Rh > MinR therefore the puck is in the "free" state.
Pa
MinR
Ra
puck is in "free" state
Rh
MinR
Ph
"Time-in" Continues
Clock "Time-in" Cycle 999+m:
(where m > Min.Time Threshold)
The Away Player (Pa) is the only Player within reach of the Puck, and the puck has been within his reach for a Minimum Time Threshold, therefore the puck is in the "possession" state and is assigned to Pa.
puck is in "possession" state
Pa
MinR
Ra
Rh
MinR
Ph
Or, Pa gains "Possession"
"Time-in" Continues
Clock "Time-in" Cycle 999+m+n:
The Home Player (Ph) is now in reach of the puck, the Away Player (Pa) is still assigned possession, but the puck is now the "contention" state.
puck is in "contention" state
Pa
MinR
Ra
Rh
MinR
Ph
Or, Ph gains "Possession"
Clock "Time-in" Cycle 999+m+n+o:
The Home Player (Ph) is now the only Player within reach of the Puck, and the puck has been within his reach for a minimum time threshold, therefore the puck is back in the "possession" state and is assigned to Ph.
puck is in "possession" state
Ph
Rh
MinR
Ra
MinR
Pa
Or, Puck goes "free"

310

*Fig. 13*

| Game Stats | Period 1 | | Period 2 | | Period 3 | | Game Total | |
|---|---|---|---|---|---|---|---|---|
| | Home | Away | Home | Away | Home | Away | Home | Away |
| Face-Offs Won | 5 | 7 | 8 | 6 | 7 | 5 | 20 | 18 |
| Turnovers | 8 | 12 | 11 | 7 | 6 | 10 | 25 | 29 |
| Hits | 5 | 8 | 7 | 6 | 6 | 5 | 18 | 19 |
| Attempts (near & on goal) | 14 | 18 | 18 | 21 | 19 | 13 | 51 | 52 |
| Shots (on goal) | 7 | 11 | 12 | 13 | 15 | 8 | 34 | 32 |
| Chances | 2 | 3 | 4 | 3 | 7 | 2 | 13 | 8 |
| Goals | 0 | 1 | 0 | 0 | 2 | 0 | 2 | 1 |
| Time of Possession (min) | 6 | 7.2 | 7 | 6.4 | 8.5 | 5.2 | 21.5 | 18.8 |
| Distance Traveled (ft) | 276 | 331 | 322 | 294 | 391 | 239 | 989 | 865 |
| Team Speed (mph of puck) | 46 | 52 | 48 | 47 | 56 | 46 | 50 | 48 |
| Penalty Minutes | 3 | 0 | 2 | 2 | 2 | 4 | 7 | 6 |

320

*Fig. 14*

| | | Period 1 | | Period 2 | | Period 3 | | Game Total | |
|---|---|---|---|---|---|---|---|---|---|
| Weighting % | Factors | Rating | Weighted Score | Rating | Weighted Score | Rating | Weighted Score | Rating | Weighted Score |
| 100% | Face-Offs | 6 | 60 | 8 | 80 | 8 | 80 | 7.3 | 73.3 |
| 100% | Passing | 7 | 70 | 7 | 70 | 8 | 80 | 7.3 | 73.3 |
| 90% | Checking | 7 | 63 | 6 | 54 | 8 | 72 | 7.0 | 63.0 |
| 100% | Line Changes | 9 | 90 | 8 | 80 | 9 | 90 | 8.7 | 86.7 |
| 80% | Breakouts | 5 | 40 | 6 | 48 | 8 | 64 | 6.3 | 50.7 |
| 100% | Rushes | 7 | 70 | 7 | 70 | 8 | 80 | 7.3 | 73.3 |
| 70% | Short Handed | 8 | 56 | 10 | 70 | 10 | 70 | 9.3 | 65.3 |
| 100% | Power Plays | 8 | 80 | 7 | 70 | 10 | 100 | 8.3 | 83.3 |
| 100% | Goal Scoring | 5 | 50 | 7 | 70 | 8 | 80 | 6.7 | 66.7 |
| 70% | Defensive Zone Play | 6 | 42 | 8 | 56 | 9 | 63 | 7.7 | 53.7 |
| 0% | Goaltending | 9 | 0 | 9 | 0 | 10 | 0 | 9.3 | 0.0 |
| 80% | Penalties | 8 | 64 | 10 | 80 | 10 | 80 | 9.3 | 74.7 |
| 100% | Space Control | 6 | 60 | 8 | 80 | 9 | 90 | 7.7 | 76.7 |
| | Combined Score | 7.0 | 7.5 | 7.8 | 8.3 | 8.8 | 9.5 | 7.9 | 8.4 |
| | *Percentage* | | *68%* | | *76%* | | *87%* | | *77%* |

SYSTEM AND METHODS FOR TRANSLATING SPORTS TRACKING DATA INTO STATISTICS AND PERFORMANCE MEASUREMENTS

RELATED APPLICATIONS

The present application claims priority to International Application No. PCT/US07/019,725, filed Sep. 11, 2007, entitled SYSTEM AND METHODS FOR TRANSLATING SPORTS TRACKING DATA INTO STATISTICS AND PERFORMANCE MEASUREMENTS and to U.S. 60/843,677, a provisional application filed on Sep. 11, 2006 entitled SYSTEM AND METHODS FOR TRANSLATING SPORTS TRACKING DATA INTO STATISTICS AND PERFORMANCE MEASUREMENTS, the contents of which are hereby incorporated by reference.

FIELD OF THE INVENTION

The present invention relates to systems and methods for translating sports tracking data into meaningful sports statistics and performance measurements.

BACKGROUND AND SUMMARY OF THE INVENTION

Currently, creating statistics concerning a sporting event is an error prone manual operation that is greatly limited by the extent of human observation. In practice, there are one or more individuals present at a given sporting contest to at least run the dock and keep score. At the more competitive and professional levels, it is not unusual to have several statisticians at the game, each tracking a particular statistic and perhaps using a laptop computer to do this in real-time.

For the remainder of the application, the present inventor will provide examples with respect to the sport of ice hockey, although it will be understood by those familiar with sports and the technologies discussed herein, that these same teachings are applicable to all sports that share at least the following traits:

1. They are played within a predefined area;
2. They include at least one player that moves about within this predefined area;
3. They may include at least one player in opposition to that player who also moves about within the predefined area;
4. They may include a game object that is used by a player as a part of scoring points to win the contest;
5. The predefined area may be broken into real or virtual areas, such as but not limited to one player's side versus the other;
6. Each opposing side, or some other portion of the predefined area, may then also have within it a specific goal area where points may be scored by a player using the game object;
7. The contest may have a time limit that is tracked by an official game clock, and
8. If there is a time limit than this total game time may be broken into segments between which the players may or may not exchange opposing sides.

There are many sports today that share these traits such as but not limited to:

Ice Hockey (Field Hockey, Roller Hockey);
American Football;
Soccer;
Baseball;
Basketball;

Tennis;
Volleyball;
Squash (Raquetball);
Etc.

Furthermore, although it is not a requirement for the benefits of the present teachings, many of these sports have opposing teams of more than one player each. In general, these team sports all follow a general pattern, specifically:

1. Each team defends their half of the predefined area that includes a goal where the other team may score points;
2. Points are scored by in some way getting the game object into, through, across, etc. the opponent's goal;
3. At the beginning of the game or one of its segments, the game object is either given specifically and alternatively to one team for its control or it is set free by a game official to be immediately contested for;
4. The team that has control of the game object tries to keep control within the game rules as they advance the game object towards the opponent's goal; this team is currently on offense;
5. The opposing team tries to gain control of the game object so that they can then proceed towards their opponent's goal, or in general they try to impede or thwart within the game rules the offensive team from getting the game object into, through, across, etc. their goal; this team is currently on defense;
6. Often either the offensive or defensive team will break the game rules, sometimes with strategic intention for which they will be penalized, and
7. Each time a team manages to get the game object into, through, across, etc. the opponent's goal, they are awarded points that are then totaled into their score and at the end of the game determine the contest winner.

Presently, there are many inventors who have proposed various ideas for following the movements of the one or more players and the game object. Some examples of their proposed devices include:

Active beacons to be worn on each player, or held within the game object that emit some form of energy that may be remotely detected and triangulated thereby providing at least position information if not also orientation and often identity;

Passive markers to be worn on each player, or on the game object, that can react with some form of tracking energy emitted from a source, where the reaction causes energy to leave the marker in such a way that it may then be detected by one or more energy detectors thereby providing at least position information if not also orientation and often identity;

Energy sensing systems that detect emitted and/or reflected energy from each player or game object without the presence or active beacons or passive markers, where the energy may then be detected and used to determine at least position information if not also orientation and often identity, or Some combination of the above.

These approaches of using active beacons, passive markers, and/or simply detecting emitted or reflected energy off of the players or game objects represent the span of total solutions for player and game object tracking known to the present inventor.

The exact method of gathering player and game object location and optionally orientation is in material for the teachings of the present invention, except that these methods provide real-time quantified data such as X, Y or X, Y, Z coordinates exactly locating a player or game object within the playing area in some known and calibrated measurement system, regardless of precision. As previously stated, the present inventor is aware of working systems including those from Trakus, Inc. of Massachusetts using active beacons and from Fox Sports using IR transmitters embedded in the game object (in practice shown for an ice hockey puck.)

In addition to Trakus, the present inventor is aware of at least one university that is also working to provide similar or variant solutions, namely the University or British Columbia.

And finally, as disclosed in referenced applications, the present inventor has also taught systems for automatically and remotely,:

1. determining the ongoing location of a player within the predefined area;
2. optionally determining the continuous orientation of the player for each determined position;
3. optionally determining, either continuously or intermittently, the identity of the player being tracked through various locations, and
4. determining the ongoing location of the game object within the predefined area.

In addition to this player and game object tracking information, the present inventor has also taught in these same referenced applications different means for obtaining official game information such as but not limited to, current or total playing time, current period or segment of the playing time, current score by team, current penalty or infraction information, etc. The present inventor is not aware of other systems similarly purposed but could imagine that they might exist and for the purposes of the present teachings the only important point is that the official game data is obtained in time combination with the player and game object tracking data.

To the best understanding of the present inventor, regardless of the apparatus or methods used to determine the player and game object locations and orientation, there are no know systems for translating this information into anything more than the simplest of statistics. Therefore, given the current state of the art in automatic systems for tracking player and game object movement as well as real-time information processing systems, it is now possible to create a new wealth of statistics, performance measurements and dynamic game momentum indicators that far exceed human based observation in their objectivity, accuracy, temporal and special granularity, scope, etc.

As will be understood by those skilled in the art of real-time data acquisition, the teachings of the present invention are therefore universally applicable regardless of the specific apparatus and methods used to collect the player and game object tracking information or the official game data. As will also be understood by those skilled in the art of sports, the teachings of the present invention are equally applicable to virtually all sports and especially those sharing the common traits previously enumerated.

It is the object of the present invention to provide apparatus and methods for automatically determining ongoing and real-time statistics and performance measurements at least encompassing those currently determined by human observation by translating the continuous input of player and game object tracking information as well as time coordinate official game data. It is still further an object that these statistics and performance measurements have several aspects that are universally comparable across levels of age and competitive experience within a given sport and even across one or more sports. It is still further an object that these statistics and performance measurements be correlated in time with not only the player and game object tracking information but also with any game video being concurrently captured at least in such a way that the information may be automatically and intelligently applied as overlays to the video stream(s). Still further objects and advantages of the present invention will become apparent from a consideration of the drawings and ensuing description.

DESCRIPTION OF THE DRAWINGS

FIG. 1 is an expanded version of the statistics that might be typically collected at a professional ice hockey game.

FIG. 4*b* is a table relating the detectable clock and puck movement states as well as the puck from-to and heading towards locations to the possession flow events depicted in FIG. 4*a*. Each of these detectable states and locations can be determined using the minimum necessary and sufficient data from FIG. 2.

FIG. 5*c* depicts an alternative design for a helmet sticker where the shapes are concentric circles or either monochromatic or color based variations in fixed size relationships so as to provide additional depth-to-sticker information via detected shape pixel size.

FIG. 8 depicts the four possible situations of puck (game object) possession with respect to two or more players (in this case opposing players,) namely: Cycle 999, the puck is outside of either player's region of control and therefore neither player can be assumed to have possession; Cycle 999+m, the puck is within a first player's region of control and outside of the second (other) player's region for at least some minimal duration and therefore possession can be assumed to rest with the first player; Cycle 999+m+n, the puck is within the region of control of both the first and second (other) player for at least some minimal duration and therefore it can be assumed that possession is being contested, and Cycle 999+m+n+o, the puck now lies within the second player's region of control and outside of the first (other) player's region for at least some minimal duration and therefore possession can be assumed to now rest with the second player.

FIG. 13 includes the traditional statistics of FIG. 1 as well as proposed new statistics and performance measurements, together far exceeding the current capacities of human observation. All of this data is shown to be calculable from the minimum necessary and sufficient data of FIG. 1, but can be refined if also using the extended data added in FIG. 7.

FIG. 14 is similar to FIG. 13 in proposing new statistics and game measurements, again wholly based on FIG. 1 data but preferably based on FIG. 7 data.

SPECIFICATION

Referring to FIG. 1 there is shown a basic set of statistics 300 that is typically collected via human observation and data entry for a professional ice hockey game. These statistics include:

- Ice Time that equals a duration that some player or group of players was in the field-of-play;
- Shots on Goal that equals the number of scoring attempts made by a player or group of players;
- Chances that equals a subjective narrowing of Shots on Goal to include only those shots perceived to have a reasonable chance of scoring;
- Goals that equals the number of scores made by a player or group of players;
- Face-Offs (Won/Lost) that equals the number of "time-in" situations where both teams are contesting for game object (puck) control where one player or group of players either won or lost the contested possession;
- Penalty Minutes that equals a duration that some player or group of players was in the penalty area, just off the field-of-play, and
- Turnovers that equals the number of times a player or group of players, first: has possession, and then second: loses possession to the opponent, typically not as the result of a time-out or shot attempt.

While not identical to other sports, these statistics 300 are exemplary of the type of information desirable to know in all sports and can be broken down into some general facts that are universally applicable, at least to opponent based sports with one or more players per team, where each team defends a goal, specifically these facts are:

- What is the breakdown of the playing area with respect to all player and game object movement, including the team bench area, the allowed field of play, the scoring or goal areas and any penalty waiting areas, etc?;
- With respect to all player and game object movement, when is official "time-in" vs. "time-out"?;
- What is the sport rule for game object possession at the point of official "time-in," i.e. does "time-in" start with possession awarded or contested?;
- Where is each player at all times during official "time-in" with respect to the playing area(s)?, and
- Where is the game object at all times during official "time-in" with respect to the playing area(s)?

Figure 2:
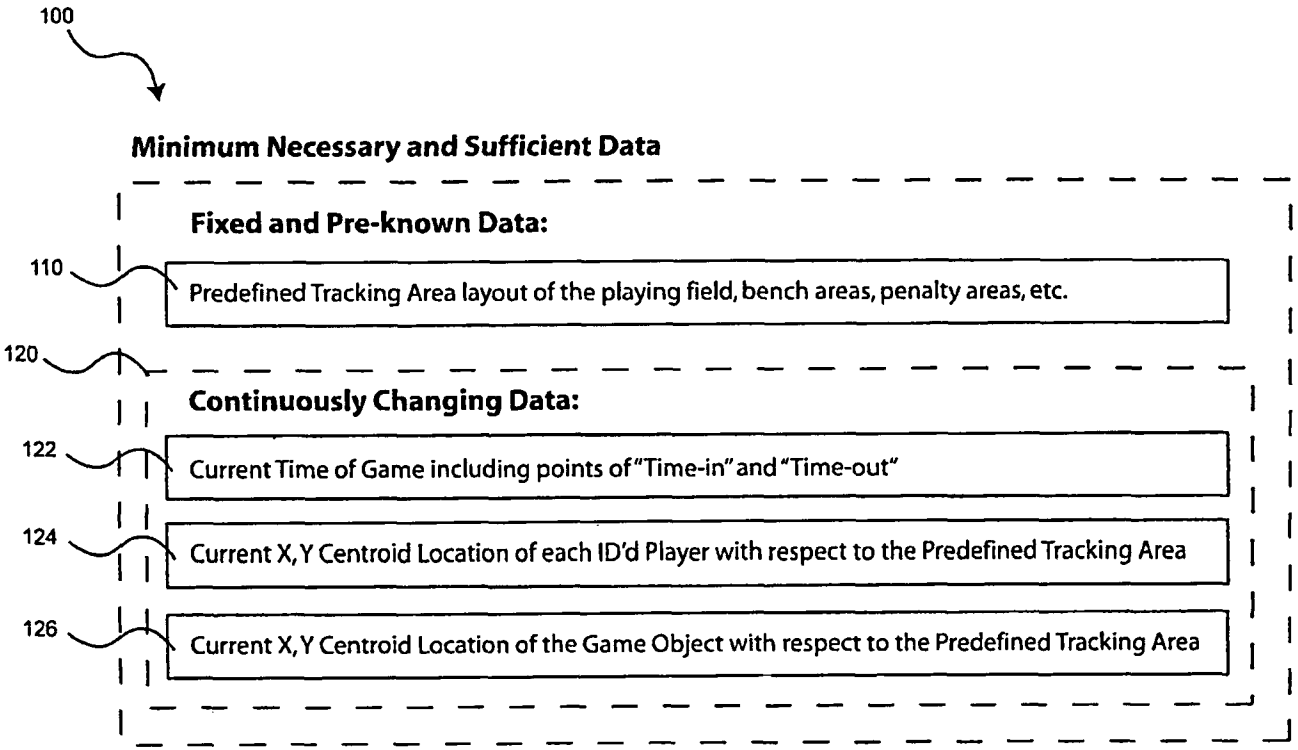
FIG. 2 depicts the herein taught minimum necessary and sufficient data for determining important and useful statistics and performance information such as depicted in FIG. 1, FIG. 13 and FIG. 14 which includes the predefined tracking area layout, the current time on the game clock, the current centroid of each player and the current centroid of the puck (game object.)

Referring next to FIG. 2, what the present inventor will show, and the core teaching of the present invention, is that there is a minimum necessary and sufficient set of data 100 that must be determined in order to automatically produce all currently collected manual statistics such as 300 and subsequently an entire new beneficial set of performance measurements (such as 310 shown in FIGS. 13, and 320 shown in and FIG. 14.) This minimum set of data 100 comprises:

Predefined Tracking Area Layout data 110 of the playing field, bench areas, penalty areas, etc.:

1. this is typically a fixed (unchanging) pre-known;

Current Time of Game data 122 including points of "Time-In" and "Time-Out":

1. this can be determined automatically by:
   a. receiving data output from the official scorer tables console that is manually operated and sends control signals to the game scoreboard (taught by the present inventor in prior referenced applications;)
   b. detecting the unique sonic frequencies indicative of a game official's whistle being blown for determining typically "time-out" but also often "time-in" (taught by other inventors;)
      some key drawbacks of this "listening" method are:
      1. false positives, e.g. from a fan blowing a whistle;
      2. low signal to noise, e.g. during extreme situations when ambient crowd noise overcomes whistle sound vibrations;
      3. susceptibility to human error in signal, e.g. when an official blows the whistle in an insufficient manor to create the necessary sonic signal, and
      4. lacks identity information, e.g. only indicates that a whistle was blown and not which official blew the whistle;
   c. detecting air-flow of a game official's whistle for determining typically "time-out" but also often "time-in" (taught by the present inventor in prior referenced applications;)
   d. detecting manual release of the game object for determining "time-in" typically initiating a contested possession situation (taught by the present inventor in prior referenced applications,) or by
   e. detecting changing patterns of energy radiation from at least one game scoreboard face that displays the official game clock for the audience (taught by the present inventor in prior referenced applications;)

Current X, Y Centroid Location of each ID'd Player data 124 with respect to the Predefined Tracking Area:

1. this can be determined automatically by:
   a. tracking active (powered) beacons affixed on some ideal central location on each player (taught by other inventors;)
      some key drawbacks of this beacon method are:
      1. requires powered beacon to be placed on player which is against most current sport league rules, is costly and is inconvenient to monitor battery life;
      2. emitted signal is typically omni-directional and therefore is useful for determining position via triangulation but does not easily provide beacon and therefore player orientation (however, note that player orientation is not a minimum fact taught by the present invention as necessary for determining the initial class of useful statistics 300);
      3. susceptible to false-positives due to signal reflections off venue structures, and
      4. requires expensive signal detecting apparatus without a broad general market to aggressively bring down costs over time;
   b. using machine vision, first: tracking gross locations of players, and second: detecting encoded passive markings placed on players to yield both centroid and identity (taught by the present inventor,) or
   c. using machine vision for first, tracking gross locations of players and using calculating centroid, and then second, for reading the jersey numbers off player uniforms and performing pattern matching/OCR to determine identity (taught by the present inventor.)

Current X, Y Centroid Location of the Game Object data 126 with respect to the Predefined Tracking Area;

1. this can be determined automatically by:
   a. tracking active (powered) beacons affixed or contained within the game object (taught by other inventors;)
      some key drawbacks of this beacon method are:
      1. requires powered beacon to be placed on the game object which may be against sport league rules, may alter the game objects performance, is costly and is inconvenient to monitor battery life;
      2. susceptible to false-positives due to signal reflections off venue structures, and
      3. requires expensive signal detecting apparatus without a broad general market to aggressively bring down costs over time.
   b. using machine vision to track the solely the game object (taught by other inventors);
      for which a key drawback is:
      1. does not also track and preferably identify the players, thus requiring an additional set of apparatus for this necessary portion of the minimum necessary set of data.
   c. or, using machine vision to track the game object while also tracking and identifying the players (taught by the present inventor.)

As will be shown in the ensuing specification, by securing this minimum necessary and sufficient set of data 100, and most particularly the continuously changing data 120, it is possible to create a wealth of important statistics 300 and other performance data 310 and 320 (of FIG. 13 and FIG. 14 respectively.) The teachings of the present invention are centered on the methods for translating this synchronized stream of minimum data 100 into useable information such as depicted in FIG. 1 and then also in FIG. 13 and FIG. 14. Although the present inventor prefers the approaches for determining this information as taught in his prior referenced applications, the present teachings do not limit the sources of any portion of the minimum data 100. For instance, the present invention will function perfectly well, and has novelty, even if:

- the official "time-in" and "time-out" are determined using the whistle "listening" approach taught by other inventors;
- the current player location and identification are determined using active beacons taught by other inventors;
- the current game object location is determined using still another type of active beacon taught by the same or other inventors, or
- the minimum data is obtained using any combination of the these apparatus or methods not taught by the present inventors, in any combination with the prior referenced teachings of the present inventor or in any combination with future as of yet unknown apparatus and methods for obtaining some piece or all of the minimum data 100.

Therefore, again referring to FIG. 2 and in varied restatement, what is most important is that the apparatus and methods taught herein have available as minimum data 100:

1. pre-knowledge of the layout of the playing field, team bench and penalty areas, data 110;
2. continuous knowledge of the time on the official game clock, data 122;

3. continuous knowledge of each player's ID and location, data 124, and
4. continuous knowledge of the game object's location, data 126.

As will be understood by those familiar with the art of real-time data collection and analysis, each captured or determined data point is synchronized to all other data points, for all types of related data, via identification with the real instance of time that the data point was taken, either in a global or local time reference system. This implies that the current game clock time data 110, which is itself data separate from the global or local time, is captured and stored in index to the global or local time. Note that the global or local time is preferably continuous and uniformly incremented while the clock time data 110 may be going uniformly forward or backward, jumping forward or backward or stopped.

Using only this input of minimum data 100, the present inventor will now proceed to teach the method steps for deriving information such as 300, 310 and 320 shown in FIG. 1, FIG. 13 and FIG. 14, with the understanding that these figures depict exemplary, rather than limiting, statistics, performance data and otherwise game related information.

Figure 3:
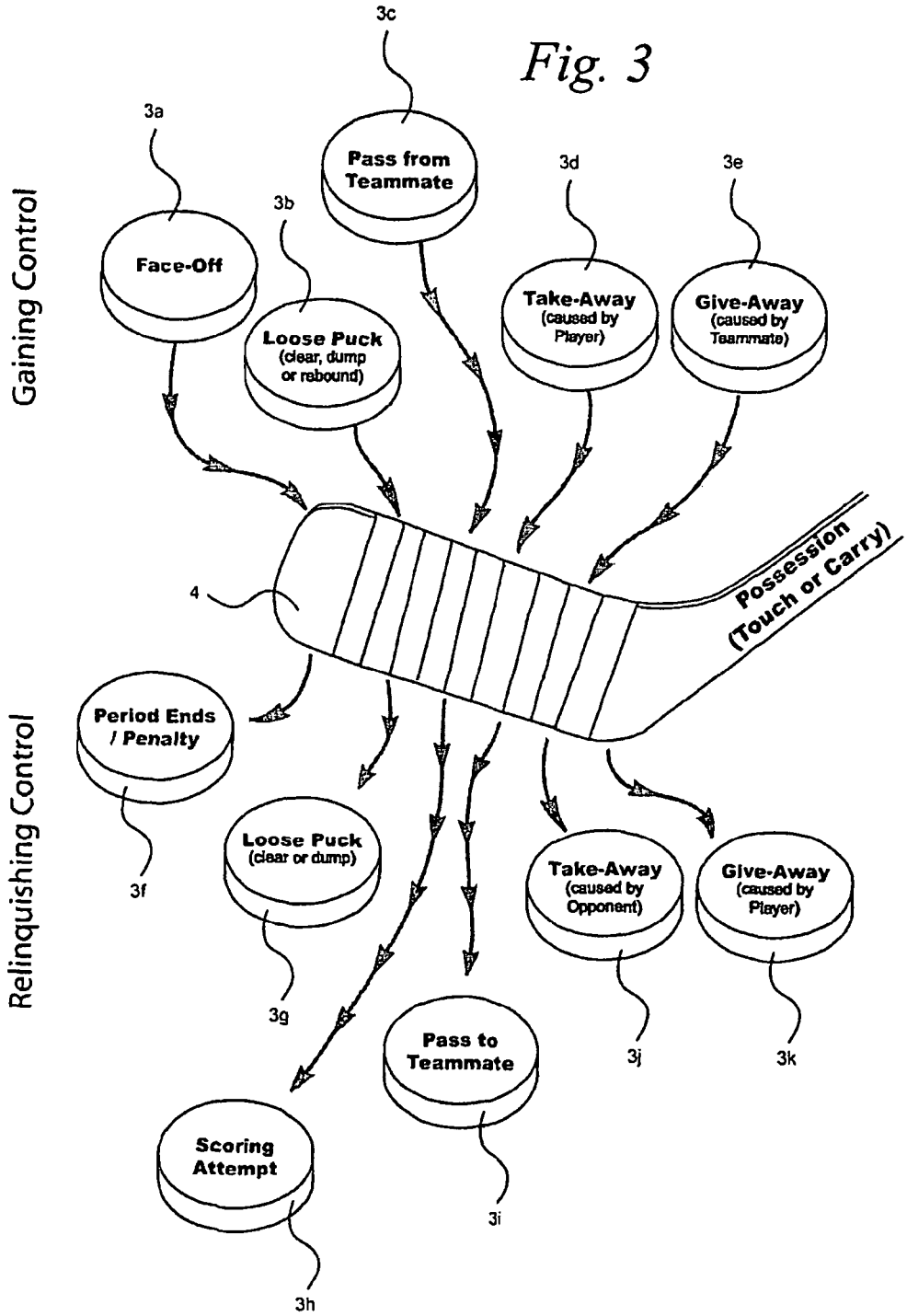
FIG. 3 is an illustration depicting the various ways that a puck (the game object) might come into, or alternatively leave the possession of a given player, via his stick (controlling equipment) blade.

Referring next to FIG. 3, there is depicted the end of a hockey stick 4 and various hockey pucks 3*a* through 3*k* representing two basic puck/player interactions, specifically "gaining control" and "relinquishing" control. (Again, as previously implied, at any point in this specification, the word "puck" is universally replaceable and equivalent to "game object" and therefore the present teachings are in no way limited to ice hockey or other puck based sports.) Furthermore, FIG. 3 along with all other figures showing sport specific ice hockey imagery is exemplary and although most other sports are played without a stick the stick itself is merely an extension of the player's body. Therefore FIG. 3 is easily recast to other sports by replacing the depiction of a stick with that of a player or indeed any other piece of equipment that a given sport might require the player to use when manipulating the game object. What is important is that in general the player directly, or through the use of allowed equipment such as a stick, may "gain control" and subsequently "relinquish control" of the game object. For ice hockey, specific examples of gaining control are:

winning a face-off (contested situation) 3*a*, usually associated with a "time-in";

picking up an uncontested or loose puck 3*b*, typically after situations referred to in ice hockey as a clear, dump or rebound;

receiving a pass from teammate 3*c;* challenging another player and then subsequently taking-away 3*d* the puck, and picking up an uncontested puck on a give-away 3*d* from an opposing player, typically after situations where the opposing player has not gained some alternative benefit such as a clear, dump or attempted shot.

Also for ice hockey and still referring to FIG. 3, specific examples of relinquishing control (which implies that the player first has possession) are:

at an official "time-out" such as the period ends/penalty 3*f*, or also any stoppage of play by the game official;

when the player Intentionally sends the puck to a specific area creating a loose puck 3*g*, typically a clear or dump situation;

when the player intentionally sends the puck towards the opponents net as an scoring attempt 3*h;* when the puck travels between two players without any interrupted possession by the opposing team in a pass to teammate 3*i;* when the puck is first contested for by an opposing player and then taken-away 3*j* by that opponent or one of their teammates, and when the player unintentionally, typically without strategic positional advantage such as in a clear or dump, gives-away 3*k* the puck to an opponent.

First, it should be noted that the each of these puck/player interactions cannot be uniquely differentiated without all four pieces of the minimum data set 100, namely (and in abbreviated description used henceforth) tracking area layout 110, dock time 122, player location and ID 124 and puck location 126; regardless of the apparatus or methods for obtaining the data set 100. Furthermore, implied in FIG. 3 and now referring to FIG. 4*a*, the detailed puck/player interactions 3*a* through 3*k* in general form a continuous possession flow 200 comprising only three discreet event types: gain control 210, exchange control 200 and relinquish control 230. Within these three event types that comprise possession flow 200, there are herein defined 14 standard events for the sport if ice hockey, the translation of which to other sports will be obvious to those skilled in the art of both sports rules and software systems.

Figure 4A:
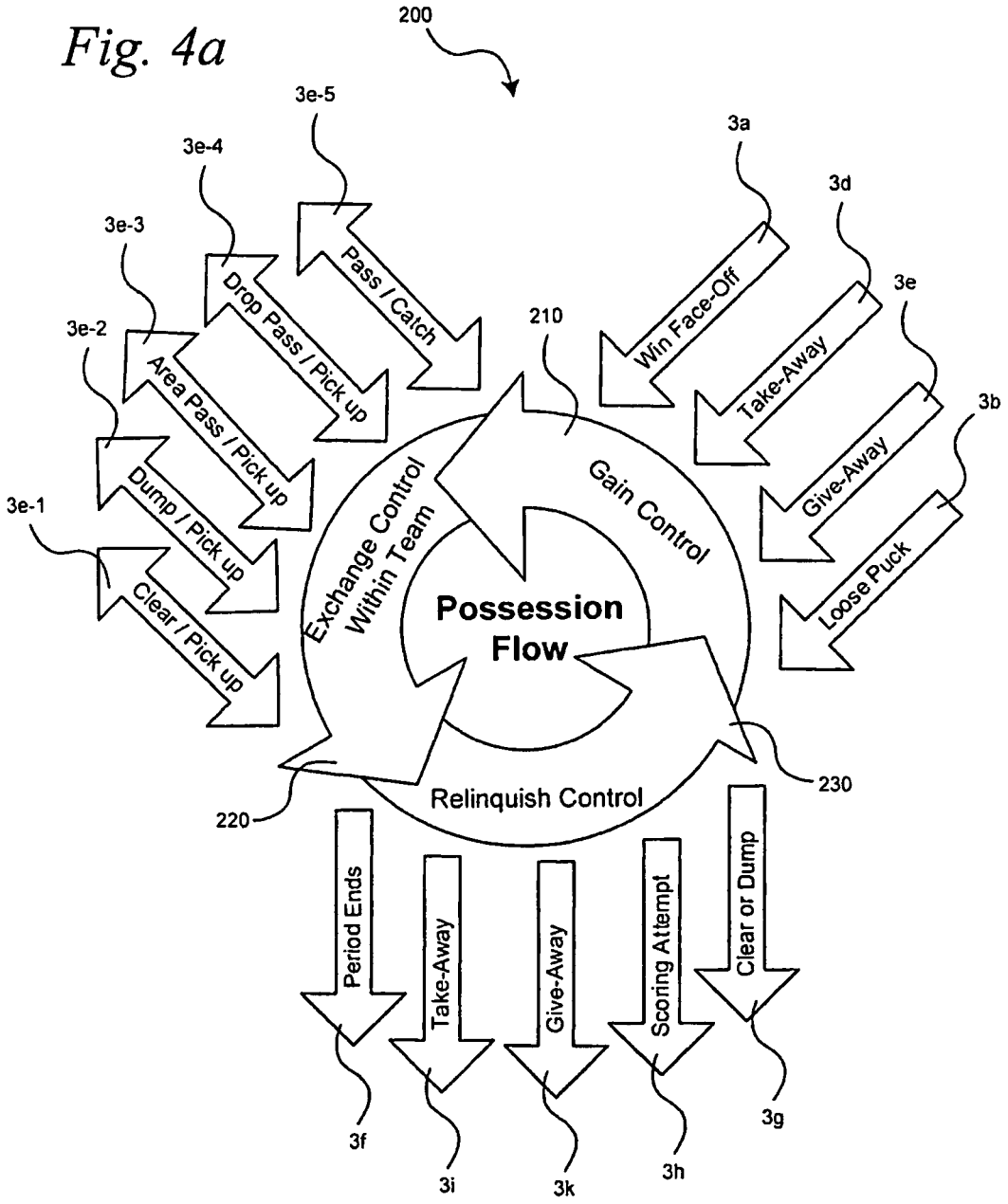
FIG. 4*a* is an illustration depicting the circular nature of the possession flow cycle within a hockey game (most opponent based sports) that consists of gaining control, exchanging control and relinquishing control.

Still referring to FIG. 4*a*, in order to gain control 210 of puck 3, a team must win a face-off 3*a*, take away 3*d* the puck from the opponent, pick up a give away 3*e* committed by the opponent or pick up a loose puck 3*b*. Within these four events, winning the face-off 3*a* and taking away the puck 3*d* involve a point where at least two opposing players will be contending for the same puck 3. One of the two will come away with the puck 3 at which time the puck is in their control, or possession. Therefore, in order to fundamentally detect events 3*a* and 3*d* an automatic system must be able to determine the puck 3 states of "in possession," followed by "under contention" and then back to "in possession," where the possession switches between opposing teams. The other two gain control 210 events, namely a give-away 3*e* and a loose puck 3*b* recovery, include puck state transitions from "in possession" to "free" and then back to "in possession," where again, the possession switches from the opponent to the team. (Note that the loose puck 3*b* recovery must be proceeded by a puck "in possession" of the opponent, otherwise it would be classified as one of the exchange control within Team 220 events.)

Still referring to FIG. 4*a*, in order to exchange control within team 220, one team's player may clear the puck 3 out of their defensive zone after which it is then first recovered by a teammate, thus creating a clear/pick up event 3*e*-1. Similarly, when approaching the attack zone a team's player may dump the puck 3 followed directly by a teammate first picking up the puck 3, thus creating a dump/pick up event 3*e*-2. When not specifically related to the defensive-to-neutral zone clear or a neutral-to-attack zone dump, any time a team's player sends the puck 3 into an open area followed directly by a teammate first picking up the puck 3, this is a area pass/pick up event 3*e*-3. A drop pass/pick up event 3*e*-4 is created when a skating player simply leaves the puck 3 and skates on by so that a trailing teammate may then first pick up the puck 3. And finally, a team's player may directly pass the puck to a teammate who then catches the puck and continues team possession, thus creating a pass/catch event 3*e*-5. All of these events 3*e*-1, 3*e*-2, 3*e*-3, 3*e*-4 and 3*e*-5 share a common pattern of puck states; namely "in-possession" followed by "free" returning to "in-possession," where the possession states are for the same team.

Still referring to FIG. 4*a*, a team may relinquish control 230 by any of the following events: the period ends 3*f*, the opposing team takes-away 3*i* the puck, a team's player gives-away 3*k* the puck, or a team's player makes a scoring attempt 3*h*.

Control may also be relinquish when a team's player clears or dumps 3*g* the puck but it is then not first picked up by the same team. Similar to gaining control 210, detecting take-aways 3*i* requires sensing a puck's transition from states of "in possession," to "under contention" followed by "in possession," where the possession if assigned to different teams. The events of give-away 3*k* and clear or dump 3*g* follow the puck states of "in possession" to "free" and back to "in possession," where possession changes between teams. The event of period ends is unique in that it only has two states, namely "in possession" followed by "time-out." Of course it is possible to go from the puck states of "free" or "under contention" directly to "time-out" as well. The scoring attempt 3*h* is a special case that starts "in possession" and then moves to "free" without any implications as to what state might be next, i.e. "under contention," "in possession" of either team or "time-out."

In reference to FIG. 4*a*, the present invention illustrates the continuously evolving states of the puck (game object,) which from its perspective may be: "free," "under contention," "in possession," or in "time-out." As will be shown, especially in reference to FIG. 8 and FIG. 9, all that is necessary and sufficient to detect these transitions is the minimum data 100, namely:

1. pre-knowledge of the layout of the playing field, team bench and penalty areas, data 110;
2. continuous knowledge of the time on the official game dock, data 122;
3. continuous knowledge of each player's location and ID, data 124 and
4. continuous knowledge of the game object's location, data 126.

Figure 9:
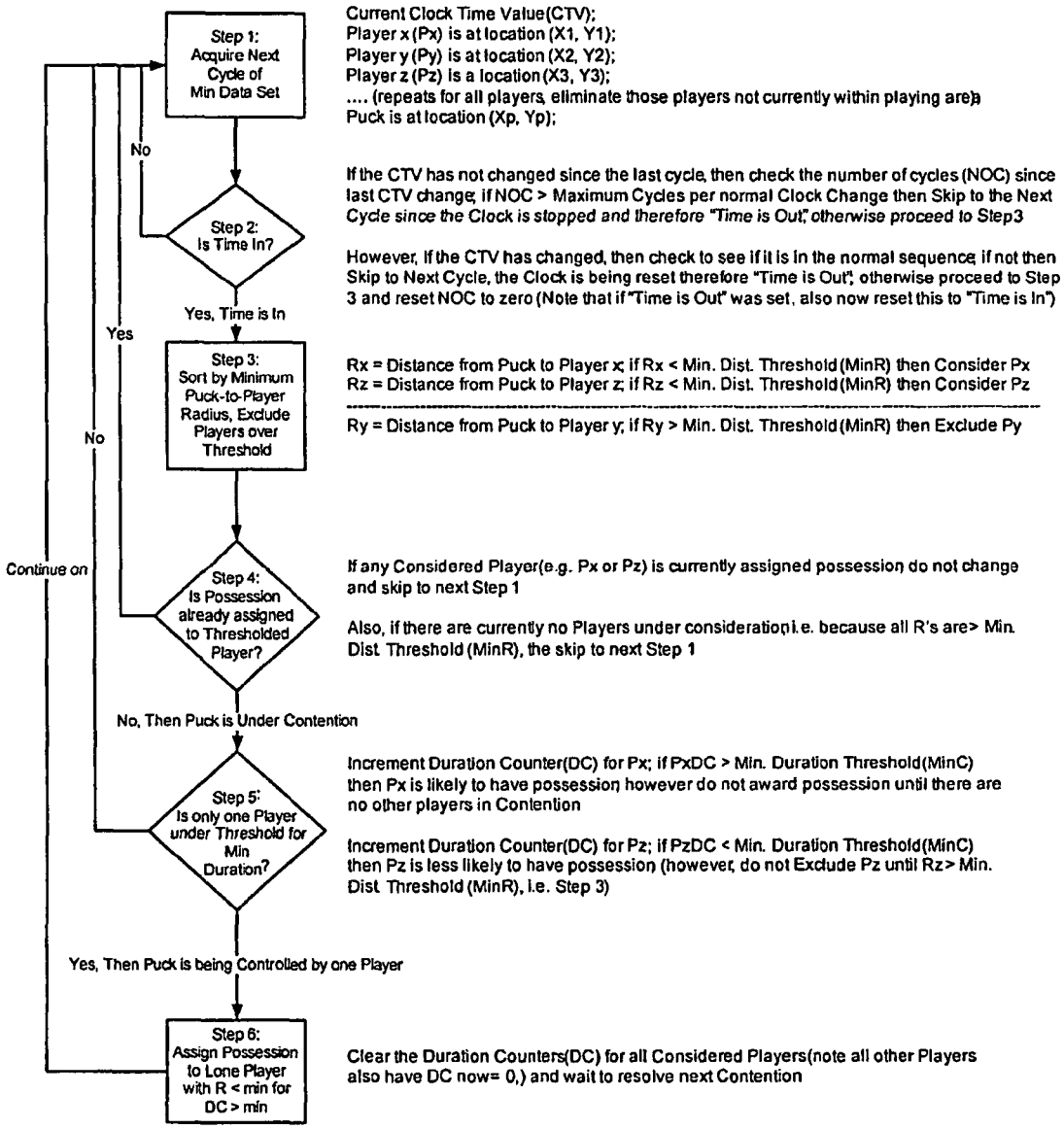
FIG. 9 depicts a flowchart tracing the steps generally corresponding to the situations shown in FIG. 8 and teaching how the minimal data of clock time, player(s) centroid and puck (game object) centroid(s) can be used to determine the revolving puck states of "free," "under contention," and "in possession."

Furthermore, as will be taught in detailed method steps in FIG. 9, all of the events 3*a*, 3*d*, 3*e*, 3*b*, 3*e*-5, 3*f*, 3*i* and 3*k* are fundamentally identical in the detection algorithm, only requiring differentiation based upon initial and ending player identities (i.e. teams) and initial and ending clock states, i.e. "time-in" and "time-out." For the determination of events 3*e*-1, 3*e*-2, 3*e*-3, 3*h* and 3*g* the method steps must include an determination of where the puck 3 is on ice sheet 2 with respect to predefined areas (as will be discussed in more detail with regard to FIG. 10, FIG. 11 and FIG. 12,) at both the initial "in possession" state as typically the end of the "free" state.

Referring next to FIG. 4*b*, the possession flow events of gaining control 210, exchanging control 220 and relinquishing control 230 are crossed indexed with the clock, player and puck states that must be detected for each event 3*a* through 3*g*. Specifically, the necessary clock states 150 are "time is in" 151 and "time is out" 152. The time-in state 151 can be determined by:

1. Monitoring the least significant digit of the clock time 12-1 (see FIG. 5*f*) found in min data 122 to determine if this digit is sequencing both at the correct update rate and numerical order.

The time-out state 152 can be determined by:

1. Detecting when the least significant digit of the clock time 12-1 fails to update within the allotted time (preferably measured by counting system cycles) or in the proper numerical order. It is noted that the system cycles proceed continuously and independently of the clock, preferably at a rate at least double that of the least significant digit and provide synchronization for continuously changing data 120, as will be understood by those skilled in the art or real-time data collection.
2. On occasion, it becomes necessary to adjust the time on the game clock. There are only two adjustments, namely adding time back onto the clock or taking it off the clock. In either case, the clock is always stopped first and therefore will be in the detected state of "time-out" 152 when the adjustment is attempted. This simplest solution is to always adjust the clock by directly entering the new desired time, rather than by sequencing up or down. Using this solution, at least one significant digit will be jumping to a numeral that is out of order, therefore easily indicating the adjustment to the present invention which will then adjust it's captured database accordingly by repairing the past stream of min data 100 and determined events, at least 3*i* through 3*g*. However, the present invention will also be able to detect running off time on the clock by also determining the location of the referee and the on-ice players when the least significant digit changes from not-updating to updating. Specifically, in ice-hockey (and at least basketball) the formation of players at any time-out to time-in transition at least includes a referee with the puck who is surrounded by two opposing players. Furthermore, in virtually all sports, there is typically an area on the playing field where each player is either restricted too, or chooses to normally align, just prior to the time-out to time-in transition. Therefore, by including predefined standard formations 114 (discussed in reference to FIG. 7) to the minimum data set 100, the present inventor also teaches detecting running time off the clock, which is really still a time-out 151 state. (Note that while previously not mentioned, it is assumed that the tracking data collection apparatus and methods used to provide minimum data 100 will include tracking the location of the referees and game officials.)

Referring still to FIG. 4*b*, there are also shown puck movement states 160. Specifically, the necessary states 160 are "free" 161, "under contention" 162, "in possession of home team" 163 and "in possession of away team" 164. While the determination of these states has already been discussed in general, they will be covered in detail with reference to FIG. 6*b*, FIG. 8 and FIG. 9. Therefore, it is here simply stated that each of these puck states 160 sufficiently determinable using only a single calculation as follows:

1. Instantaneous puck-to-player distance: this is a measure of the distance R between each player n, with current location (Xn, Yn), and the puck, with a current location (Xp, Yp). This calculation is performed using the well-known Distance Formula as follows:

$$R=Sqrt[(Xn-Xp)^2+(Yn-Yp)^2]$$

As will be further taught in the ensuing specification, the puck will be assigned a "free" state 161 as soon as all players are at a distance R that exceeds the minimum threshold used to indicate how close a player must be to the puck 3 in order to be able to gain control. Essentially, if no players are in reach of the puck, then the puck 3 must be "free" 161. As will also be further taught, if the puck is solely within the reach (i.e. R<min) of one player for some minimum duration threshold, than it will be assigned the "in possession" state 163 or 164. By checking the player's ID, state 163 vs. 164 may be differentiated. And finally, as will also be subsequently taught, if the puck 3 is currently "free" 161 and two or more player's come within reach of it (i.e. R<min) before any one player exceeds the minimum duration threshold, then the puck will be assigned the "under contention" state 162. While not necessary for determining at least statistics 300 and most of statistics 310 and 320, the present inventor teaches the determination of a new puck state "under challenge" 165 (not shown in FIG. 4*b*). This state 165 is optionally set when the puck 3 is "in possession" of a sole player when an opposing player subsequently comes within reach of the puck (i.e. R<min.) This "under challenge" state 165 therefore indicates that one player first has control/possession where "under contention" state 162 would then indicate that neither player first had control/possession.

Referring still to FIG. 4*b*, there are shown puck zone locations 170 including defensive zone 171, neutral zone 172 and attack zone 173. By continually keeping tracking of the puck zone locations 170, especially at each puck state 160 transition, the exchange control events 220 including 3*e*-1, 3*e*-2 and 3*e*-3 as well as the relinquish control events 230 including 3*h* and 3*g* may be sufficiently differentiated. Specifically:

- the clear/pickup event 3*e*-1 starts with a team "in possession" 163 in their defensive zone 171, followed by a "free" puck 161, followed by the same team "in possession" 163 in the neutral 172 or attack zones 173. This same method holds for relinquishing clear event 3*h* except that team possession necessarily changes;
- the dump/pickup event 3*e*-2 starts with a team "in possession" 163 in their neutral zone 172, followed by a "free" puck 161, followed by same the same team "in possession" 163 in the attack zone 173. This same method holds for relinquishing dump event 3*h* except that team possession necessarily changes, and
- there are several area pass/pick up event 3*e*-3 from-to zone possibilities as depicted in FIG. 4*b*. In particular any from-to locations staying in the same zone or going "backwards" from the attack zone 173 to the neutral zone 172, or from the neutral zone 172 to the defensive zone 171.

And finally, still referring to FIG. 4*b*, there are shown puck heading directions 180 including teammate not directly behind player 181, teammate directly behind player 182, opponent 183, open ice 184 and opponent's goal 185. Using this additional information, the following additional events can be differentiated:

- drop pass/pick up 3*e*-4 is towards a teammate directly behind the player 182 last in possession 163;
- pass/catch 3*e*-5 is towards a teammate not directly behind the player 182 last in possession 163, and
- scoring attempt 3*h* is towards the opponent's goal 185.

Figure 5A:
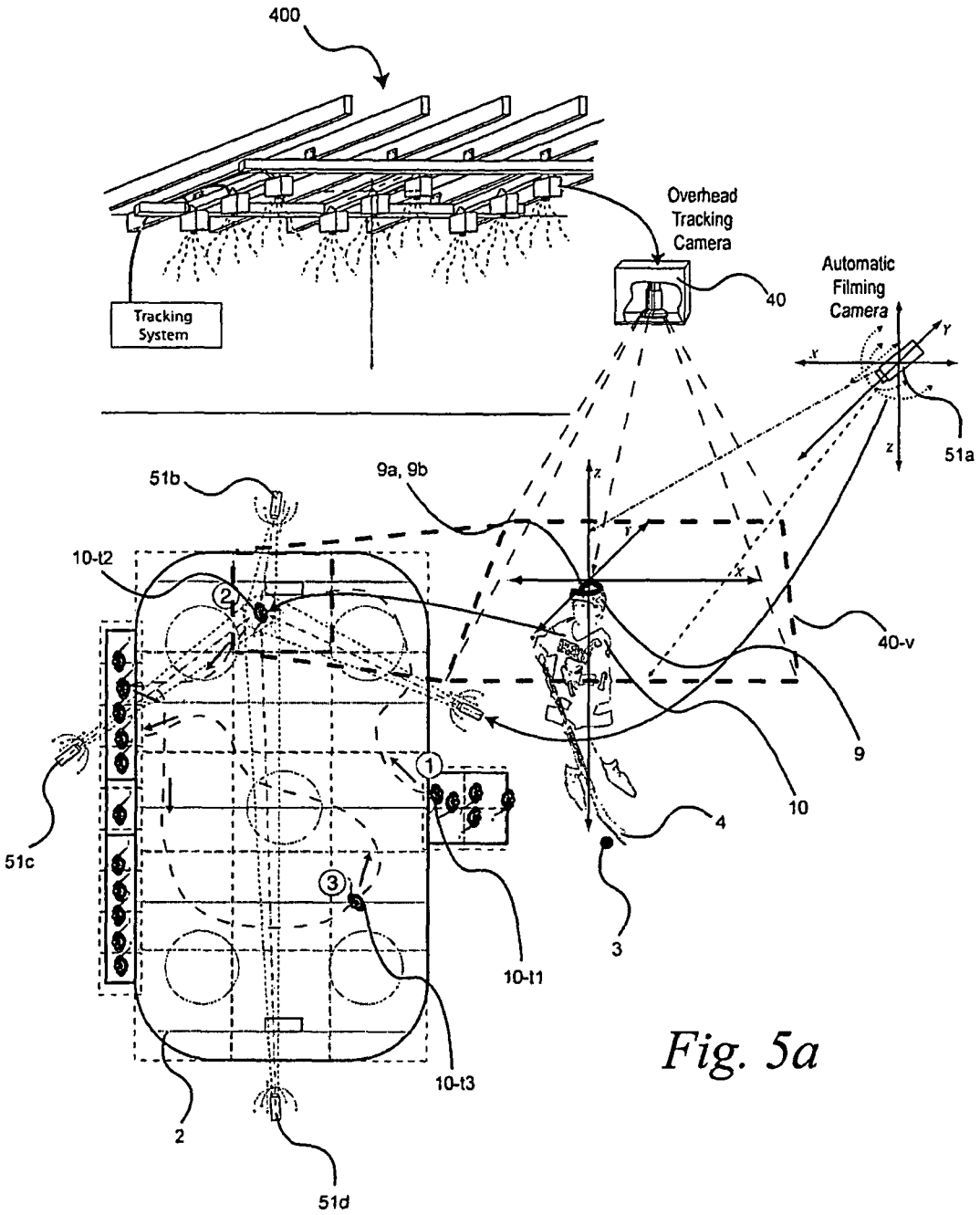
FIG. 5*a* depicts apparatus and methods taught by the present inventor in prior referenced applications that teach the use of an a first grid of overhead tracking cameras that provide data to a tracking system that in turn uses standard machine vision algorithms to at least continuously track each player's current position and potentially their orientation and identity. In the preferred embodiment the players are wearing some encoded passive marker on there upper surface mostly in view of the tracking cameras, where this marker might be a helmet sticker.

Referring next to FIG. 5*a*, there is shown the preferred system for determining player and game object tracking information as first disclosed by the present inventor in referenced U.S. Pat. No. 6,576,116 B1 entitled Multiple Object Tracking System. The figure itself was also repeated in its entirety in referenced U.S. application Ser. No. 05/013,132 entitled Automatic Event Videoing, Tracking and Content Generation System (see FIG. 3 of this referenced application.) FIG. 5*a* depicts an overhead tracking system 400 comprising a matrix of tracking cameras 40 maintaining a overlapping and substantially parallel view of the predefined playing area such as ice sheet 2. As players 10 move about with stick 4 on ice sheet 2, they will also interact with the game object, in this example puck 3. Using its view 40-*v*, each tracking camera 40 tracks the movement of any and all players 10, equipment 4 and puck 3 providing at least two dimensional coordinates in any acceptable format such as X, Y rectangular notation. If the tracking system 400 includes multiple layers as taught in the referenced applications especially including U.S. Ser. No. 05/013,132 then it is possible to add a third dimension of tracking, i.e. Z for height, as will be well understood by those familiar in the art of three dimensional machine vision. Using the tracked two dimensional locations of each player 10, stick 4 and puck 3, the tracking system 400 may also automatically pan, tilt and zoom automatic filming cameras 51*a*, 51*b*, 51*c* and 51*d* in order to record desired game action. The X, Y two dimensional tracking information determined for each player 10, stick 4 and puck 3 by this preferred tracking system is sufficient to serve as continuously changing player centroid data 124 and game object centroid data 126 as discussed in FIG. 2. As also taught in the same prior applications, player 10 may have affixed for example to their helmet 9 a uniquely encoded marker such as helmet sticker 9*a* or 9*b* (discussed in more detail in FIG. 5*b* and FIG. 5*c* respectively) that allows the tracking system 400 to further uniquely identify each player 10.

Using these stickers 9*a* or 9*b*, or some similar equivalent, player centroid data 124 therefore also includes identity along with X, Y location information.

While tracking system 400 is the present inventor's preferred tracking system for indoor sports, there are other systems suggested by other inventors as mentioned in the referenced applications and the background to the present invention that are capable of determining this same tracking information sufficient to serve as player data 124 and game object data 126. The present inventor is at least aware that the system provided by Trakus, which employs RF transmitters in the player's 10 helmet 9, has already been implemented and works to provide at least continuous X, Y location and identity. Trakus has been assigned U.S. Pat. No. 6,204,813 B1 entitled Local Area Multiple Object Tracking System by Wadell et al, covering this technology. The present inventor is also aware that in U.S. Pat. No. 5,594,698 entitled Electromagnetic Transmitting Hockey Puck by Honey et al. teaches a method of tracking the three dimensional location of a puck 3 that has been implemented as a working product, euphemistically dubbed "the Fox puck" and assigned to Fox Sports Broadcasting.

With respect to the teachings of the present invention, these systems from both Trakus and Fox Sports are themselves sufficient to supply continuously changing player location and identity data 124 and game object data 126, and may be used rather than the present inventors preferred embodiment of the overhead tracking system 400. The source of the data sets 124 and 126 is therefore immaterial to the novelty of the present invention. What is important is the understanding that each system, such as that provided by Trakus that provides only player data 124, or such as that provided by Fox Sports that provides only game object data 126, are by themselves insufficient to fully support the creation of the higher levels statistics and performance measurements taught herein. At the very least, as first discussed in FIG. 2, both data sets 124 and 126 must be obtained as well as current "time-in" vs. "time-out" game data 122. Neither the Trakus nor the Fox Sports patents teach of a method for gathering game data 122, nor do they discuss the method steps for determining game object possession by players necessarily requiring all data 122, 124, 126. It should be further noted that neither the Trakus nor Fox Sports systems has been accepted by the marketplace in large part because of their lack of utility in regards to their narrowly restricted datasets.

Figure 5B:
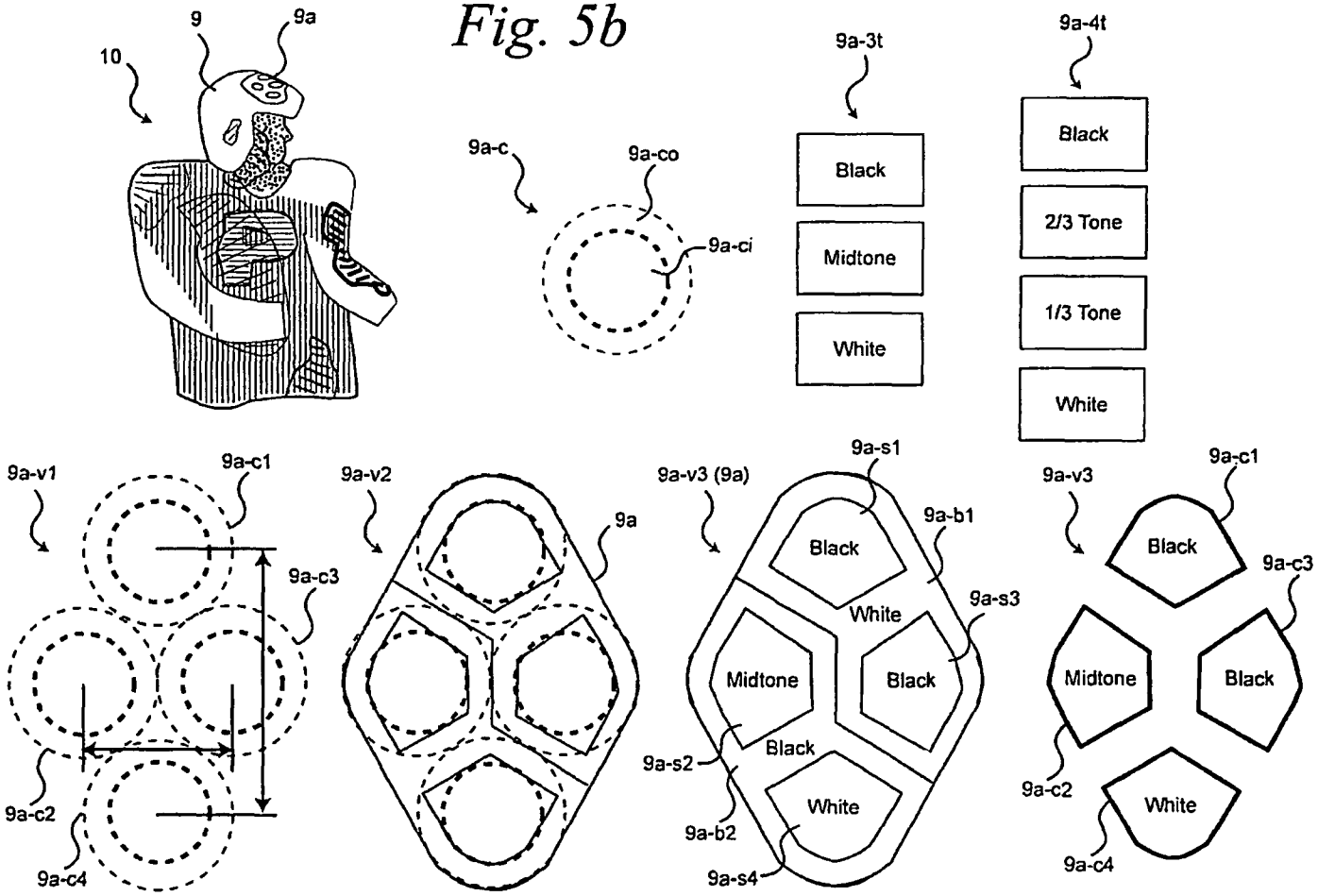
FIG. 5*b* depicts a design for an encoding helmet sticker taught by the present inventor in prior referenced applications that uses a monochromatic tone and shape based encoding method.

Referring next to FIG. 5*b*, there is shown the preferred embodiment of a helmet sticker 9*a* to be affixed to helmet 9 being worn by player 10. The present inventor first taught this specific sticker 9*a* arrangement in referenced U.S. application Ser. No. 05/013,132 entitled Automatic Event Videoing, Tracking and Content Generation System (see FIG. 6*f* of this referenced application.) The present inventor has successfully implemented a tracking algorithm to dynamically follow and decode sticker design 9*a* along with puck 3 using a single tracking camera 40. Since the sticker design itself is not material to the teachings of the present invention, but rather is used as an example of a preferred method for determining player identity using machine vision, the remainder of FIG. 5*b* will not be discussed in detail as it is in U.S. application Ser. No. 05/013,132.

Referring next to FIG. 5*c*, there is shown for the first time by the present inventor an alternative helmet sticker 9*b*. Similar to sticker 9*a*, sticker 9*b* uses circular shapes 9*b*-*c*1, 9*b*-*c*2 and 9*b*-*c*3 along rectangular background 9*b*-*b* to provide four separate color or monotone intensity variations. As will be understood by those skilled in the art of machine vision, if each shape 9*b*-*c*1, 9*b*-*c*2, 9*b*-*c*3 and 9*b*-*b* each took on one of only three unique values in contrast to each other, than $3^4$=81 unique combinations could be represented. Using four unique values would provide 256 combinations thus allowing each sticker to uniquely and directly encode each player 10's jersey number from 1 to 99. However, in these respects sticker 9*b* is essentially the same as sticker 9*a*.

The advantages of sticker 9*b* are the use of the various sized circles 9*b*-*c*1 within 9*b*-*c*2 that are at fixed and pre-known dimensions of 2× and 4× as shown. Furthermore, circle 9*b*-*c*3 is also 2× in size but only 1× distance away from larger circle 9*b*-*c*2. This arrangement provides two major opportunities. First, it provides a more distinct configuration for determining player helmet 10 orientation because circles 9*b*-*c*1, 9*b*-*c*2 and 9*b*-*c*3 act to roughly form a larger arrow type shape pointing forward in the direction of circle 9*b*-*c*3. Second, the shapes themselves provide for a greater ability to be measured in their size by tracking camera 40's image analysis. Hence, as player 10 raises and lowers his helmet 9, it is most likely that larger circle 9*b*-*c*1 will stay in some sort of view and that the resulting number of pixels detected to be within 9*b*-*c*1 will give an approximation of the distance of sticker 9*b* from tracking camera 40, as will be understood by those skilled in the art.

Hence, using sticker 9*b*, overhead tracking system 400 could determine player 10 helmet 9 height with only a single layer of tracking cameras 40 as taught in the prior applications (thus saving system costs.) The higher the resolution of these cameras 40 per the same imaging area 40-*v*, the more accurate this technique will be—again, as will be understood by those familiar with imaging algorithms. Using the changing pixel size of at least circle 9*b*-*c*1 along with the detected presence or not of circle 9*b*-*c*3, the overhead tracking system will be able to indicate if a player is bending forward and therefore pointing their head down versus standing up straight. While this information is not necessary for determining the statistics and performance measurements as described in the present invention, it does offer additional value in combination with all other necessary data.

Figure 5D:
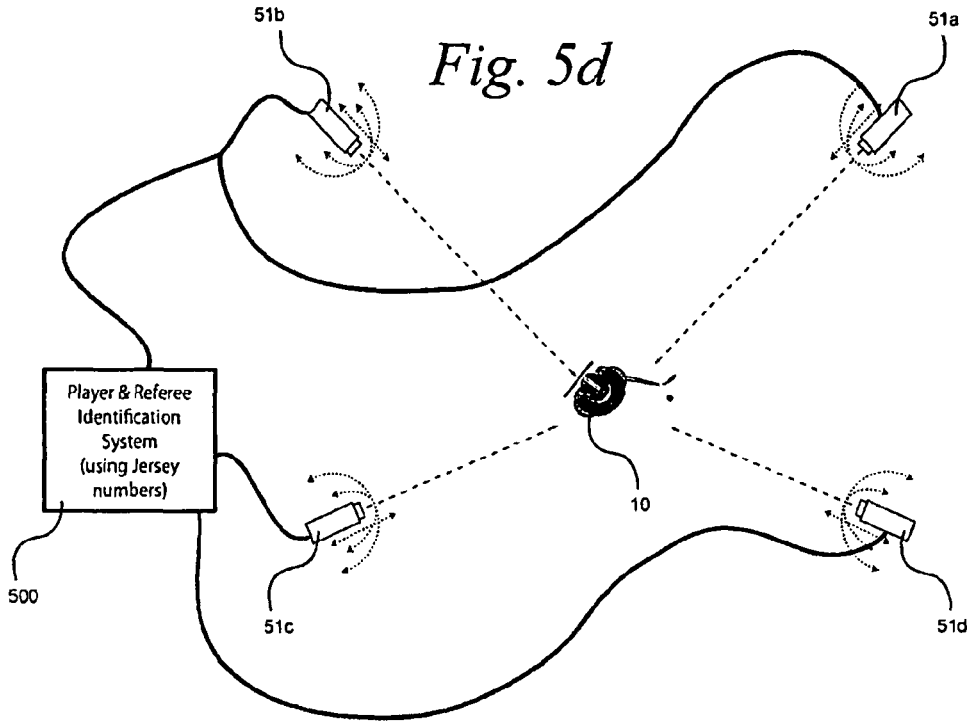
FIGS. 5*d* and 5*e* depict apparatus and methods taught by the present inventor in prior referenced applications that teaches the use of a second set of player identification cameras that are automatically directed to follow the player based upon location information first determined by the overhead tracking cameras. The result is to capture images of each player's official jersey number, the pictures of which are then processed via pattern matching and related well known machine vision techniques in order to determine each player's unique number and therefore identity.

Referring next to FIG. 5*d* there is shown a top view of the concept first taught by the present invention in U.S. application Ser. No. 05/013,132 entitled Automatic Event Videoing, Tracking and Content Generation System (see FIG. 14 of this referenced application.) While not an identical depiction, FIG. 5*d* shows that any number of automatically controlled filming cameras, such as 51*a*, 51*b*, 51*c* and 51*d*, can be directed based upon overhead tracking system 400 data to periodically capture images of any given player 10, preferably in open space on ice sheet 2, in order to capture a zoomed in image of player 10's jersey.

As taught in the prior application and as will be understood by those skilled in the art of image analysis and pattern matching, the unique aspects of the jersey number will be sufficient to provide player identification. As was taught in the referenced applications, it is not necessary to continuously identify each player 10 since once identified by such a technique, they can be followed by the overhead system 400 without ambiguity, even as players 10 begin to crowd together. And, in those cases where two or more players 10 merge from the overhead view to such an extent that their identity needs to be confirmed, as these same players ultimately separate cameras such as 51*a* through 51*d* can be directed to recapture jersey number images for identification. Furthermore, if only two players are in question and their identities where known prior to bunching up, than it is only necessary to re-identify one of the two since the other's identity may then be set based upon this prior knowledge. As will be understood by those skilled in the art of image analysis, pattern matching is greatly aided by the pre-knowledge of which actual jersey numbers are on the team (rather than all possible,) which jersey numbers are now detected on the ice (a sub-set of all team numbers,) and which two or more players have bunched together (a further sub-set)—all of which favorable limits the pattern matching possibilities and have been taught by the present inventor.

Figure 5E:
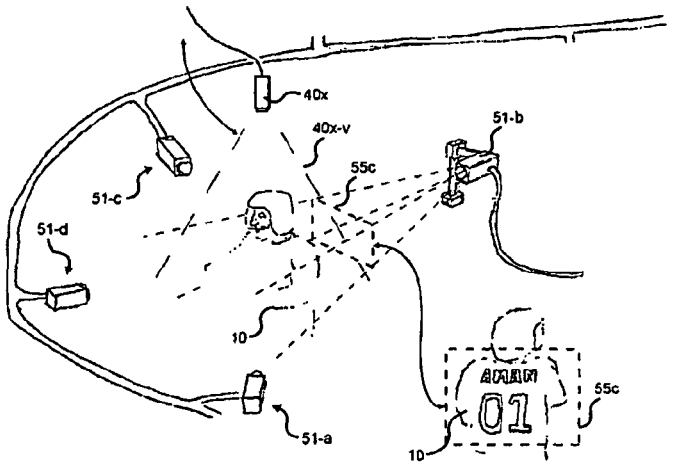
Figure 5F:
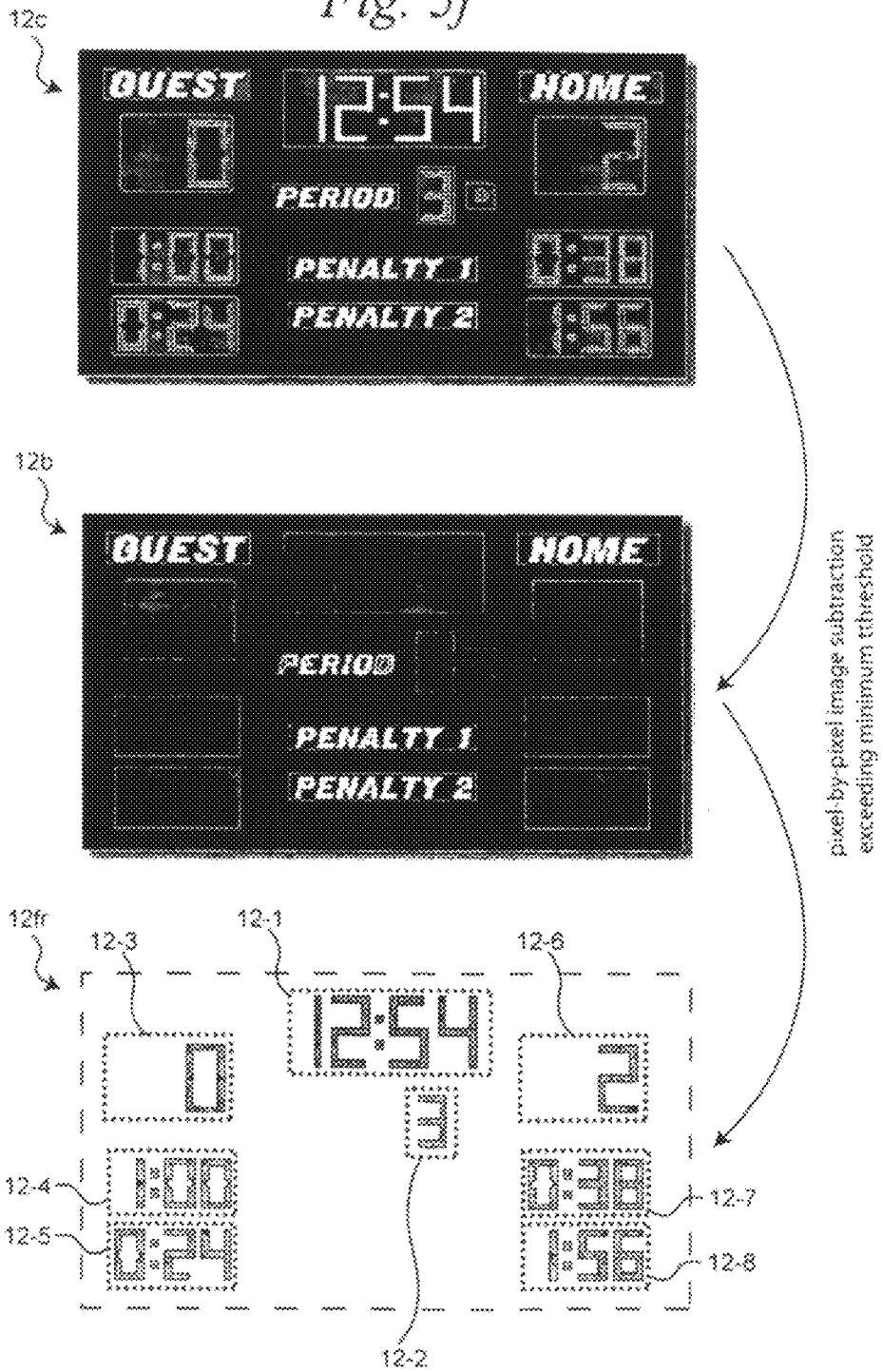
FIG. 5*f* depicts apparatus and methods taught by the present inventor in prior referenced applications that teach the use of machine vision to remotely and continuously translate the visual character output of the game scoreboard into digital information, segregated appropriately into meaningful titled groups, in a time synchronized fashion with the collected game video and game tracking information.

Referring next to FIG. 5*e*, there is shown a portion of the drawing (FIG. 14) from U.S. application Ser. No. 05/013,132. This figure is provided as further illustration of a preferred alternative to using helmet stickers 9*a* or 9*b*, which are themselves preferred by the present inventors over active transmitters such as used by Trakus. As discussed in the prior referenced applications, by using machine vision, rather than RF tracking, additional valuable data, i.e. the video itself is gathered. Furthermore, machine vision techniques provide enough information to help determine player 10's orientation, and not simply two or even three dimension location of one point on their body plus identification. As previously mentioned, and as will be discussed in respect to upcoming FIG. 7, player 10's current orientation data 128 can add very useful data for performance analysis. At the very least, it can distinguish a player skating forward versus backward, which the Trakus approach cannot do.

In practice, the present inventors have found that helmet stickers can be purchased for less than $0.10 per player and are therefore easily added to the helmet 9 and then discarded. However, if it is desirable at the more competitive levels to have no markings whatsoever, then using the jersey matching approach depicted in FIGS. 5*d* and 5*e* becomes more advantageous. It should be noted that the present inventors referenced teachings are not limited to helmet stickers such as 9*a* and 9*b* for markers. For instance, any mark such as one placed on the shoulder straps of a basketball player's jersey would suffice to support the teachings of a uniquely encoded marker on an upper facing surface of the player 10 such that it is consistently viewable by tracking cameras 40.

Figure 6A:
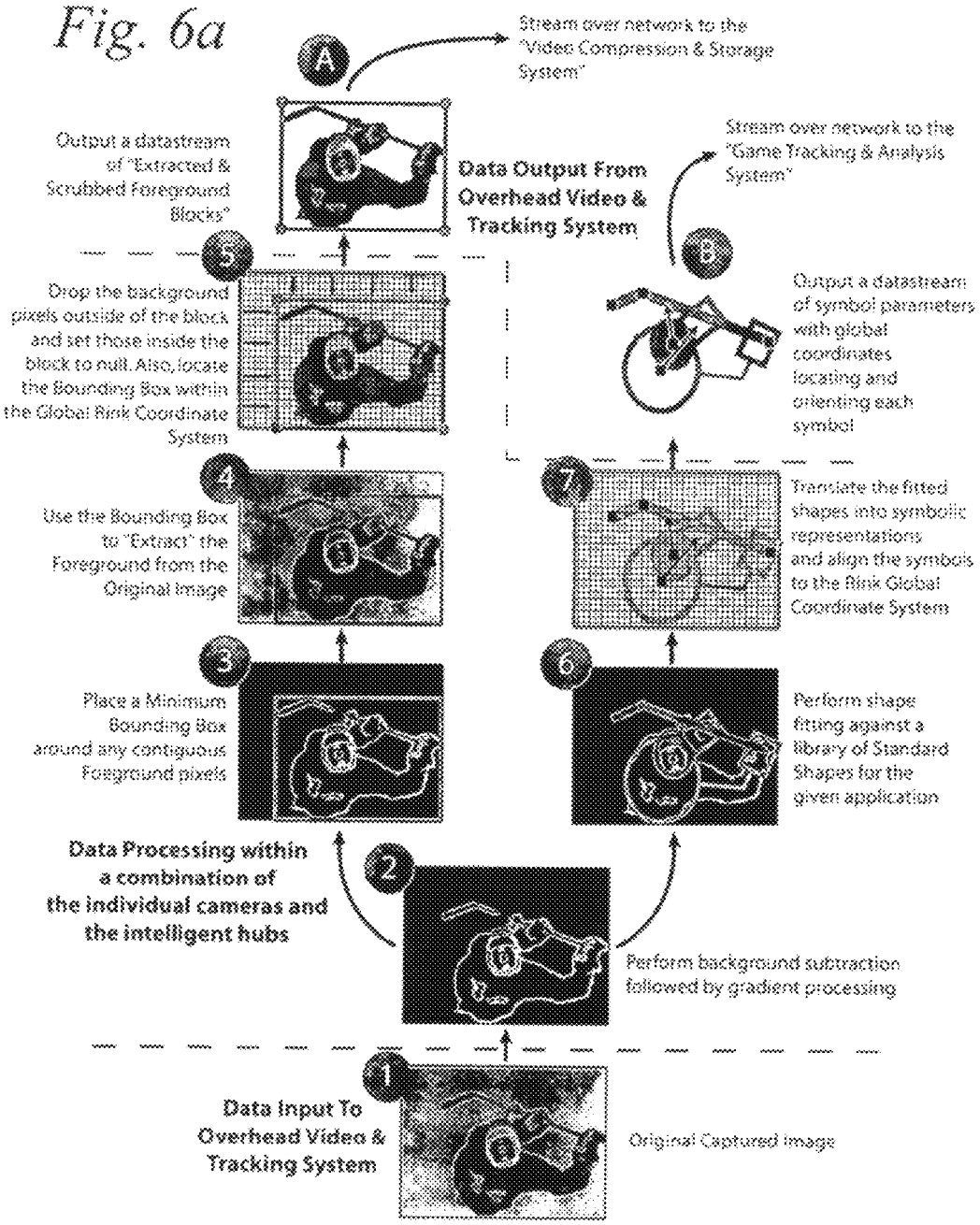
FIG. 6*a* depicts a method taught by the present inventor in prior referenced applications that teaches the steps of first: capturing a current image of a portion of the playing area with a single overhead camera; second: subtracting this current image from a stored background image of the same area taken when it was known that no players or foreground objects were present and then performing some variant of edge detection on this subtracted image to obtain a gradient image; third, searching the gradient image for all spatially isolated foreground objects that might be one or more players, players' sticks, the game object or some combination, and for each isolated foreground object searching to detect the location of any encoded markers such as a helmet sticker or the location of the game object such as the puck, and: forth, to output this continuously determined helmet sticker location and orientation information as well as the stick location, puck location, as found within any given current image.

Referring next to FIG. 6*a*, there is shown a summarization of the video image analysis teachings of the referenced patents, stating with U.S. Pat. No. 6,567,116 B1, entitled Multiple Object Tracking System. Tracking cameras 40 capture some playing surface 2 area such as 20'×20'. As has been taught in the referenced applications and as will be understood by those skilled in the art of image analysis, within this area, isolated players (or multiple bunched players) form a foreground object that can be uniquely bounded by a minimal rectangle. The preferred algorithms would include the steps of image subtraction to first remove static background pixels followed by edge detection and enhancement to Identify the outermost boundaries of the foreground shapes, which may then be fitted within an extraction rectangle. At the bottom of FIG. 6*a* there is shown an extracted image of a player labeled as "1". In practice, this same extracted video shown as "1" is actually first available as a gradient image "2" that is used to set the bounding box.

This process of bounding then limits the pixel area where a more detailed process is employed in order lead to extracted and scrubbed foreground block "A" at the top left of FIG. 6*a* and symbolic image "B" shown at the top right. Within the process of creating "B," the image analysis routines may also detect and decode any helmet sticker such as 9*a* or 9*b* that may have been present, therefore providing identity. Note also that the process of determining "B" also creates at least the X, Y location of player 10 centroid within the camera view 40*v*, which is translatable to the entire playing surface 2, as has been taught in referenced applications and is well understood in the art. Note that ideally player 10 is wearing a helmet sticker such as 9*a*, and that this sticker once identified in the image can serve as the player 10's centroid for location tracking. However, other techniques can be used to estimate that player 10's centroid if the jersey pattern matching approach of FIG. 5*d* and FIG. 5*e* is preferred. These techniques would at least include placing a best fit oval around the pixel mass of the foreground object. This mass could be chosen as the entire foreground object including stick 4, arms and torso. Or this mass could be just the torso that may be deduced by first removing all "extended" pieces of the foreground object such as the stick and arms. Or, this mass could be just the helmet, which is at a fixed known size, shape and color and will almost always be found within the torso (depending upon the player's body orientation with respect to the overhead camera 40.) Any method could be used to create a bounding oval which then provides a centroid for tracking purposes.

As discussed in referenced applications, this works best when each player 10 is completely isolated from all other players from the cameras viewpoint; something much more likely given an overhead view 40*v* rather than a side view. However, even from the overhead view 40*v* players will eventually bunch up. In these cases, both the prior knowledge of the moving oval shapes as they headed into the bunched up configuration, plus the pre-knowledge of the possible maximum sizes of players 10 standing in mostly upright positions, leads to multiple techniques for splitting larger foreground shapes with multiple players into estimated minimal shapes which are then translated into a centroid where the centroid is checked to see that it lies on its earlier detected path of travel. Of course, using uniquely encoded markers such as helmet sticker 9*a* (or a mark on a player 10's shoulders) provides a near continuous method for determining player 10 centroids even in the situation where they bunch up from the overhead view 40*v*. All of which has been discussed by the present inventor in the referenced applications.

Again, what is most important is that some reliable method is used to provide the continuous player location and identity data 124 and game object data 126. From this point forward in the present teachings, it is assumed that this data is made available from some source.

Figure 6B:
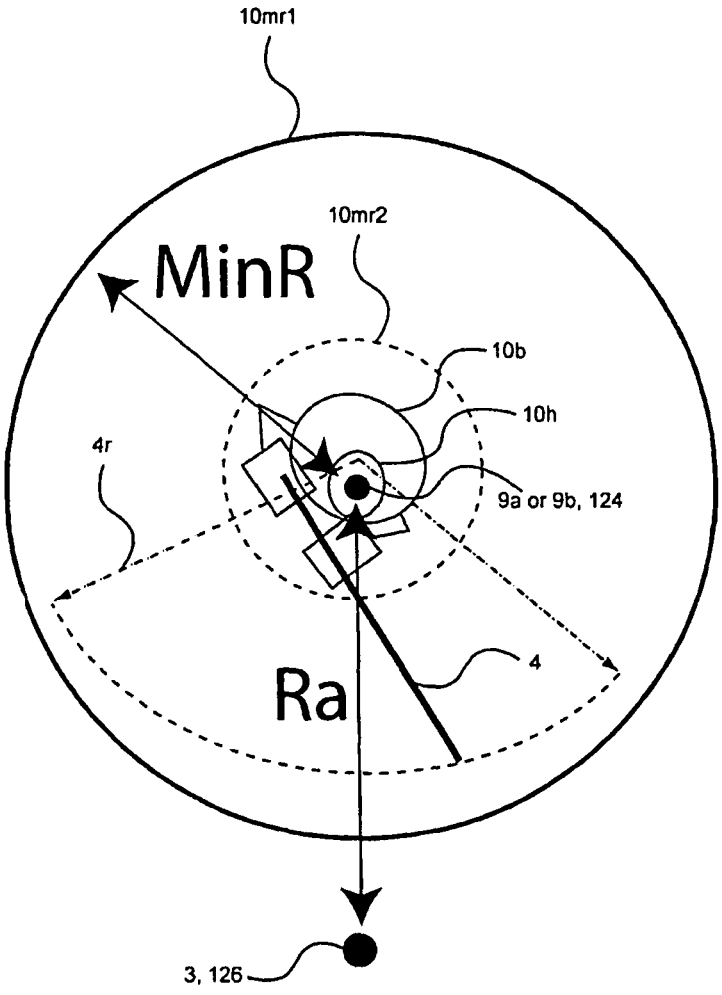
FIG. 6*b* depicts an animation that may be created based upon each player's located helmet sticker and stick as well as the puck. The helmet sticker may be directly translated into the location and orientation of the player's helmet while additional machine vision can be used to place an oval around the player's body, rectangles around their gloves and sticks for arms. From the minimum data of just the helmet sticker location and the puck location, a continuous distance from player-to-puck may be calculated and compared against a minimum distance threshold; where the player may only be assigned possession if the puck is within reach, calculable as the player-to-puck distance being less than the minimum distance threshold.

Referring next to FIG. 6*b*, there is shown a symbolic representation of player 10 as determined in process B of FIG. 6*a*, where the player 10's continuous centroid and identity data 124 was ideally created using the helmet sticker such as 9*a* or 9*b*. Also shown but not necessary is helmet oval 10*h* and body oval 10*b*. Together with the outer detected edges of player 10's arms, body oval 10*b* forms a first inner player bounding circle 10*mr*2. For each player 10, their exact preferred stick 4 length 4*r* may be known or it is easily estimated, or it may be dynamically measured. In any case, starting with either player 10 centroid 124 or inner bounding circle 10*mr*2, a second outer bounding circle 10*mr*1 is determinable as the farthest expected area of influence from the player 10's current location at any given instant. It should be further noted, that this outer circle 10*mr*1 of possible influence is further limited to some reasonable arc spanning roughly 180° directly in front of player 10, which is knowable if centroid data 124 is augmented with orientation information (as would be provided by a helmet sticker such as 9*a* or 9*b* or similar shoulder markings and even jersey numbers if they could be consistently identified, which is less likely from the side view positions when player 10 begin to bunch.)

As previously discussed in relation to FIG. 4*b*, simply knowing player centroid data 124 and game object/puck centroid data 126, it is possible to calculate the distance R between any given player 10 and the puck 3 at each given data capture moment. Also as discussed, knowing this distance provides a simple, deterministic verses probabilistic step for answering the question as to whether or not a given player 10 may have possession of the puck 3. Essentially, if the puck 3 is beyond some minimum distance MinR, then the player 10 cannot possibly have possession. If it is within MinR, then the player may or may not have possession, but it is possible. Hence, the puck 3 state of "free" is easily and continuously determinable using only the information of player centroid data 124 and game object centroid data 126. Other than the "free" state, as previously mentioned it is ideal to determine with the game object is "in possession" and "under contention" with the further possibility of distinguishing "under challenge" as a puck 3 that was first "in possession" of one player 10 and then entered the "under contention" state with a second player 10.

Referring next to FIG. 8, (and for now skipping FIG. 7,) there is depicted the transition of the game object/puck from the "free" state, to the "possession" state, to the "contention" state and then back to the "possession" state. The transitions are shown as four evolving illustrations of configurations between two players 10 Pa (away team) and Ph (home team) as well as the puck 3. In quick review, the leftmost illustration shows the puck 3 clearly out of reach of both players 10 Pa and Ph and therefore in a "free" state. As show to the right of this, some time later "m seconds" later, the puck 3 is within reach of player 10 Pa and has been there for a minimum necessary amount of time MinT in order to designated that the puck 3 is now "in possession" of player 10 Pa. As shown to the right of this, at some time "m+n second" later, player 10 Ph has neared player 10 Pa enough so that he is now also in reach of the puck 3, which is therefore in a "contention" state. And finally, to the right of this it is shown that player 10 Ph has proceeded past player 10 Pa with the puck 3 still within his reach for the MinT, which is therefore in his exclusive "possession."

This simple approach to determining the puck states of "free," "in possession" and "under contention" are solely based on the minimum necessary and sufficient data 100. The method steps, which are reviewed in detail with respect to upcoming FIG. 9, include determining the distance between each player 10's centroid and the puck 3 at some periodic and continuing rate (e.g. 30 per second) throughout the contest. At any given instant, i.e. for each distinct measurement interval, the state of "free" is immediately determinable and not dependent upon any other prior measurement intervals. However, as will be understood by those familiar with sports such as ice hockey and soccer, it is possible for an individual player 10 to push the game object, e.g. the puck 3 or soccer ball, ahead of themselves in their direction of motion. In some cases, the game object will move outside of their MinR but could still be considered in their "possession."

To adjust for this action, what is taught is that by switching from the instantaneously determined separation between each player 10 and the game object, i.e. "R instantaneous," to the average separation, i.e. "R average," this dribble forwarding will be drawn back towards MinR and the same methods will continue to indicate that the correct player is "in possession." It is anticipated by the present inventor that the exact number of measurements to average together is variable based at least upon the sport. It is further anticipated that it will be useful to include a second larger MaxR beyond which the game object is automatically set to the "free" state even if the "R average" does not end up exceeding MinR over the same interval of measurements. This would be the case for example when a hockey player 10 might dump the puck 3 forward from the neutral zone into the attack zone after which they recover this dump in within a short span of time by going around a slower moving defensemen 10, as will be understood by those familiar in the sport of ice hockey. It should also be understood that by using R as the determination for any possible puck 3 possession, side to side movement of the game object by a player 10 is effectively ignored. Hence, as will be understood by those familiar with ice hockey, the puck is often moved back and forth from left to right in the direction of player 10 travel as they skate forward or backwards down the ice. This left to right movement will tend to have little to no appreciable effect on the player 10 to puck 3 "R instantaneous" and especially "R average" distance.

With respect to the selection of the "minimum time threshold" MinT for which the game object, e.g. the puck 3, must stay within MinR based upon either "R instantaneous" or "R average," it should be noted that two additional pieces of information are helpful. The first is simply a preset value based upon the sport and does not need to be collected during the contest. This is the average rate of travel of the game object, e.g. the puck 3 in ice hockey vs. the ball in soccer, where the puck 3 when free will tend to travel at a significantly faster velocity. This rate will directly dictate how quickly the game object can pass through the max sphere of influence of a given player, where this MaxSphere would be 2*MinR. The faster the rate of game object travel, the less time it would physically spend with reach of a player 10's MaxSphere, thus indicating the MinT can be reduced. As will be understood by a careful reading of the present teachings, this rate of travel of the game object in its "free" state is an ongoing variable that can be automatically determined during game play based solely upon the current centroid location of the game object data 126, within the minimum necessary and sufficient data 100. Thus, the present inventor prefers dynamically adjusting/resetting MinT at least each time the game object (e.g. puck 3) transitions between one state, e.g. "in possession" to "free."

Using this method for refining the determination of "in possession," it will be immediately understood that a soft-pass traveling at for example 26 mph will take more time to pass through the MaxSphere of any given player 10 than would a hard pass traveling at 53 mph or a shot traveling at 92 mph. Furthermore, and also solely based upon min data 100, MinT can be further dynamically adjusted by accounting for the movement of each player 10 (and therefore their MaxSphere) with respect to the direction of travel of the game object. Hence, MinT is appreciably different for a player 10 as he travels directly forward on a parallel path but ahead of a teammate currently "in possession" than it would be for an opposing player 10 quickly converging on that same "in possession" player 10, especially if the opponent is coming directly at this "in possession" player 10 along his direction of forward travel. Thus, the opponent's MinT is dynamically reduced as he closes in on the "in possession" player 10 in a direction opposite to that player 10's travel while the teammate is dynamically extending his MinT by traveling at least at a matching speed in the direction of the "in possession" player 10.

As can be seen by a careful reading of the present teachings, MinT is best calculated dynamically by considering the current direction of traveling path (trajectory) and velocity of the game object, the current direction of traveling path (trajectory) and velocity of each individual player 10 with respect to the game object, as well as that player 10's MaxSphere. Furthermore, these calculations are best reset by each game object transition from at least the states of "in possession" or "under contention" to "free" and then back again, especially because these transitions will have the greatest effect on the average velocity of the game object. All of which can be done using minimum necessary and sufficient data 100.

While noting that min data 100 is sufficient to supply these ongoing calculations, the present inventor now teaches the importance of the preferred overhead tracking system 400 for collection player 10 location and identity versus other methods such as the active beacon taught by Trakus. Specifically, using the overhead tracking system 40 based upon analysis of images from cameras 40, especially using helmet stickers **9*a* or 9*b* or some equivalent upper body markings, it is possible to determine each player 10's orientation along with their location. As discussed in the referenced application and as will be will be understood by those skilled in the art of RF triangulation techniques, determining orientation from the omni-directional beacon signal is problematic at best. Whereas, using machine vision, player 10 features, and especially affixed markers such as sticker 9*a***, easily yield this information.

As will be understood by those familiar with sports, the value of orientation can be significant with respect to understanding the player 10's "nominal sphere" versus their "max sphere," which is necessary less considering, for example, their ability to receive or interact with a game object that is behind them versus in front of them. Hence, while not necessary for effective determination of the state of "in possession," the present inventor prefers a further enhancement to possession assignment by potentially requiring the game object to be within a determinable maximum arc of influence in front of player 10, as is roughly indicated in FIG. **6*b* as the area easily in sweep of player 10's stick 4. As will be understood by those familiar with mathematics, this area of influence is a sector of the circle that is easily approximated using the player 10's centroid as the centerpoint, the player 10's stick 4 reach as the radius, and a preset number of degrees to the left and right of the player 10's forward orientation direction as the span of the arc segment. Using this further preferred by not necessary player 10 orientation information, the present invention easily distinguishes between a puck 3 moving or resting behind a given player 10 for more than the dynamically calculated MinT so that "possession" which might normally be credited to that player 10** might rather be deterministically withheld.

Also in keeping with the information contained in min data 100 as well as the teachings of MinR as a "possession boundary," it will be understood by those familiar with both mathematics and sports, a further refinement is possible as an override to the basic method steps already taught.

Specifically, it will often be possible to detect a change in the path of the game object as it passes through the player 10's nominal or max spheres. Especially in the case where the player 10 in question is separated from all other player's 10 by at least MinR, if the path of travel of the game object is detected to have been changed in either its trajectory or acceleration by some minimum value while in that player 10's sphere, it is possible to assign the "in possession" state in less than MinT. For instance, in the case of ice hockey, a pass of puck 3 traveling at significant velocity may be received by a teammate player 10 in such as way that within three measurements it can be determined that the puck 3 has effectively altered its travel in the direction of the pass. The use of three measurements corresponds to the mathematically minimum data to determine acceleration versus velocity, where velocity is calculable with two data points, the change in velocity, or acceleration requires two velocity measurements and hence a minimum of three total measurements, as will be understood by those familiar with mathematics. As will also be understood, detecting a change in the trajectory of a moving object also requires a minimum of three measurements.

Hence, it is further taught that a change in the game object's current trajectory or acceleration, re-calculable each instant using the prior two instant's measurements, may be a sufficient and ideal override for awarding possession to a given player 10. As will be understood by those familiar with the sport of ice hockey and tracking systems, given the speed of the traveling game object and the rate of measurements, it may well be that the first of the three game object positions used to calculate the current trajectory and acceleration may well be outside of the given receiving player 10's MinR. Hence, within an effective minimum of two measurements within a player 10's sphere of Influence, the present invention can conclusively detect the transaction of the game object from "free" to "in possession" based upon its change in either trajectory or acceleration (with the technical understanding that a change in trajectory implies a change in acceleration, at least along the path of current travel.) As will be appreciated by those skilled in the understanding of object movements and mathematics, these two measurements represent the minimum number necessary to conclusively determine possession.

It is also noted that in the case of the overhead tracking system 400, in some instances the overhead view may not conclusively locate the game object. This is especially true for ice hockey where the puck 3 is small and typically travels at ground level and therefore is often underneath a player 10 and out of the view of any overhead tracking camera 40. However, in these cases the prior determined trajectory, acceleration and velocity of puck 3 as it enters any particular player 10's nominal or max sphere, along with a similar understanding of the trajectory, acceleration and velocity of that same player 10's sphere, can be used to adequately estimate the expected location of the puck 3 if it is not influenced by that same player 10 as it passes through their sphere of influence. This is a variation and implication of the MinT setting that simply indicates that if not otherwise impeded, the puck 3 would be expected to pass through the player 10's sphere and therefore certainly become visible (unless it enters another player's sphere) by the overhead system 400 within a determinable time and at determinable location.

Using a careful understanding of the present teachings, it can be seen that the trajectories, velocities and acceleration of a "free" game object as well as all of the players 10 are determinable based a minimum of three data points and therefore may be constantly reset for each next measurement once two measurements have been received, all based upon minimum data 100. Furthermore, using this deterministic information, possession of the game object can be awarded even during an instant when it cannot be visibly or otherwise detected, especially when using a tracking system such as 400. This is essentially done by "not detecting" the puck 3 on the background portion of the viewed area 40*v* where it would be expected to exist if its trajectory and velocity of travel were unimpeded as it passes through a player 10's sphere of influence. While the method steps specifically taught with respect to MinR and MinT for determining possession provide a potentially slower but also simpler method for detecting the "in possession" state, it is clear that the present invention teaches variations of the use of the minimum necessary and sufficient data 100 that can reduce the amount of time MinT necessary to conclusively determine the "possession" state to a minimum of three measurements while the game object is within the player 10's sphere of influence, or even two if the first of the three are obtained when the game object is beyond the player 10's MinR. This may even be true if the game object such as the puck 3 is not detected in third measurement, again based upon its determined trajectory and velocity.

Therefore, what is of most importance is that the present invention teaches that the detection of the most critical game object possession states of "free," and "in possession" (as well as the less critical states of "under contention" or "in challenge") are deterministically calculable using the minimum necessary and sufficient data 100. This teaching for instance, demonstrates a new value to the player data 124 and the game object data 126, where both data sets 124 and 126 have been available to the sports marketplace as pieces but never used in the combination taught herein. Specifically, at least in ice hockey at the professional levels, tracking the current player 10's location and identity has been possible using active beacons as demonstrated by Trakus while tracking the current location of the puck 3 has been possible using IR signal detection as demonstrated by Fox Sports. What was lacking was the novel understanding taught herein that combining this information along with the state of the game clock 122 would yield a much more important data set 120 leading directly to the continuous determination of the events 210, 220 and 230 of the game's possession flow 200 as depicted in FIG. 4*a*. This possession flow 200 information provides significant data as shown in FIG. 4*b* that goes well beyond any statistics independently calculable by only knowing player 10 or puck 3's location. As herein taught, it is the ability to measure the possession states of the game object as discussed in FIG. 8 and FIG. 9 that are necessary for providing a completely objective and automated system for determining the basic statistics such as shown FIG. 1 as well as the even more comprehensive statistics shown in FIG. 13 as will be discussed.

As will be understood by those familiar with the various sports, this concept of measuring the possession state of the game object remains the same for all sports including but not limited to ice hockey, soccer, basketball, football and baseball. Applying the techniques herein taught for ice hockey to other sports will be obvious to those skilled in the arts of object tracking and the various sports.

Referring next to FIG. 9, the present inventor suggests one sufficient set of deterministic steps predicated solely on the minimum necessary and sufficient data 100 for distinguishing the game object, for instance puck 3's states of "free," "in possession" and "under contention" (as well as the less critical "in challenge" discussed but not depicted.) The flowchart shown in FIG. 9 contains the relevant textual description for this method and is fully consistent with the descriptions provided earlier in relation to FIG. 4*a* and FIG. 4*b*. The teachings of FIG. 9 are also consistent with the discussion of FIG. 6*b* and FIG. 8, all of which will be understood to those familiar with object tracking and sports.

Returning now and in reference to FIG. 7, there is depicted minimum necessary and sufficient data plus extended data A 102. To the fixed and pre-known data of minimum necessary and sufficient data 100 there has been added predefined size of helmet, size of body, size of stick, etc. 112 representing additional pre-knowable information that will at least enhance the effectiveness of image analysis accompanying for instance the steps depicted in FIG. 6*a*, as will be understood by those skilled in the art of machine vision. Also added to data set 100 to form data set 110 is predefined standard formations 114 that can be used to at least help detect plays during typical "line-up" times that often take place just before the game officials set the game clock to time-in. This information is also anticipated to be useful during game play, especially with sequential and distinct play by play sports such as American football, where the initial position of the players is followed by scripted paths that should ideally match pre-set and practiced plays, included in the scope of standard formations 114.

Added to continuously changing data 120 is the current x, y orientation of each player 10's helmet 9 with respect to the predefined tracking area 2. As has been discussed and will be discussed in relation to upcoming figures, knowing the orientation of the player can provide very useful information. While the orientation of the player's head is not identical to the orientation of their body, it can both be used as an approximation and it can define at least important information regarding the player 10's current field-of-view, which conversely cannot be revealed simply by knowing their body's orientation. However, as will be understood by those skilled in the art of machine vision and image analysis, it is possible, especially with the added use of helmet stickers such as 9*a* or 9*b*, or with the alternate use of unique markings on the upper shoulders to either side of the head, to also or only detect the player 10's body's orientation. If not using marks, than proven techniques include shape analysis for which at least the pre-known and defined sizes of the helmet 9 (or bare head,) the size of the body as included in data 114 become very helpful.

Figure 7:
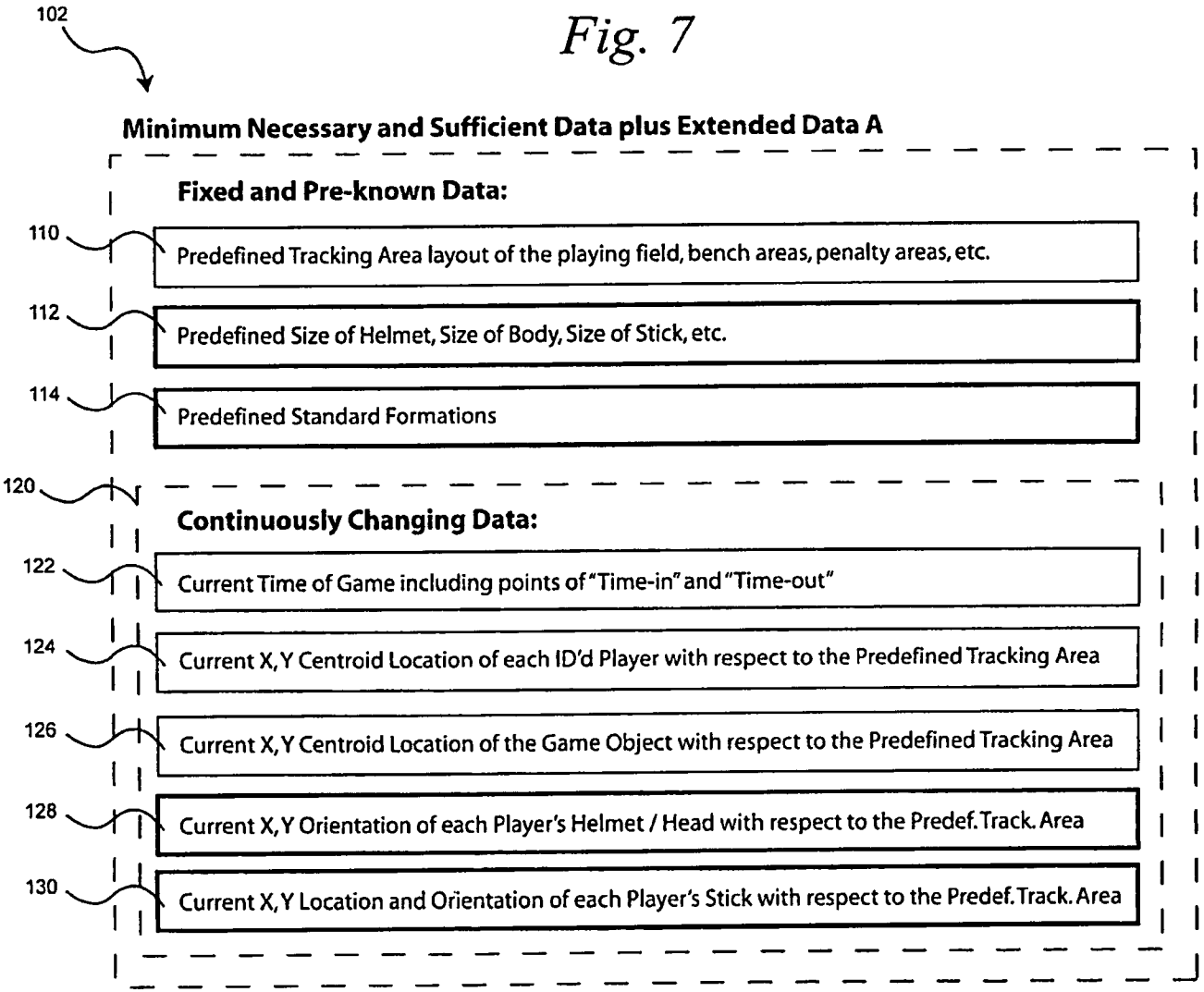
FIG. 7 depicts pre-known information such as the size of the player's helmet, body cavity, stick, etc. that is added to the minimum fixed and pre-known data shown in FIG. 2. Also depicted is helmet sticker orientation, as well as stick location and orientation, that is added to the minimum continuously changing data shown in FIG. 2.

And lastly in reference to FIG. 7 and extended dataset 110 there is shown the inclusion of the current location and orientation of each player 10's stick 4 as data 130. This information is only relevant for sports such as ice hockey, lacrosse and in some limited sense baseball. However, for especially ice hockey, knowing the current location and orientation of stick 4 provides added means for refining the moment of possession and/or game object trajectory deflection as well as the new statistical information of stick positioning such tracking if it is currently on the ice, if it is waiving back and forth through an opponent's passing lane, etc.

Figure 10:
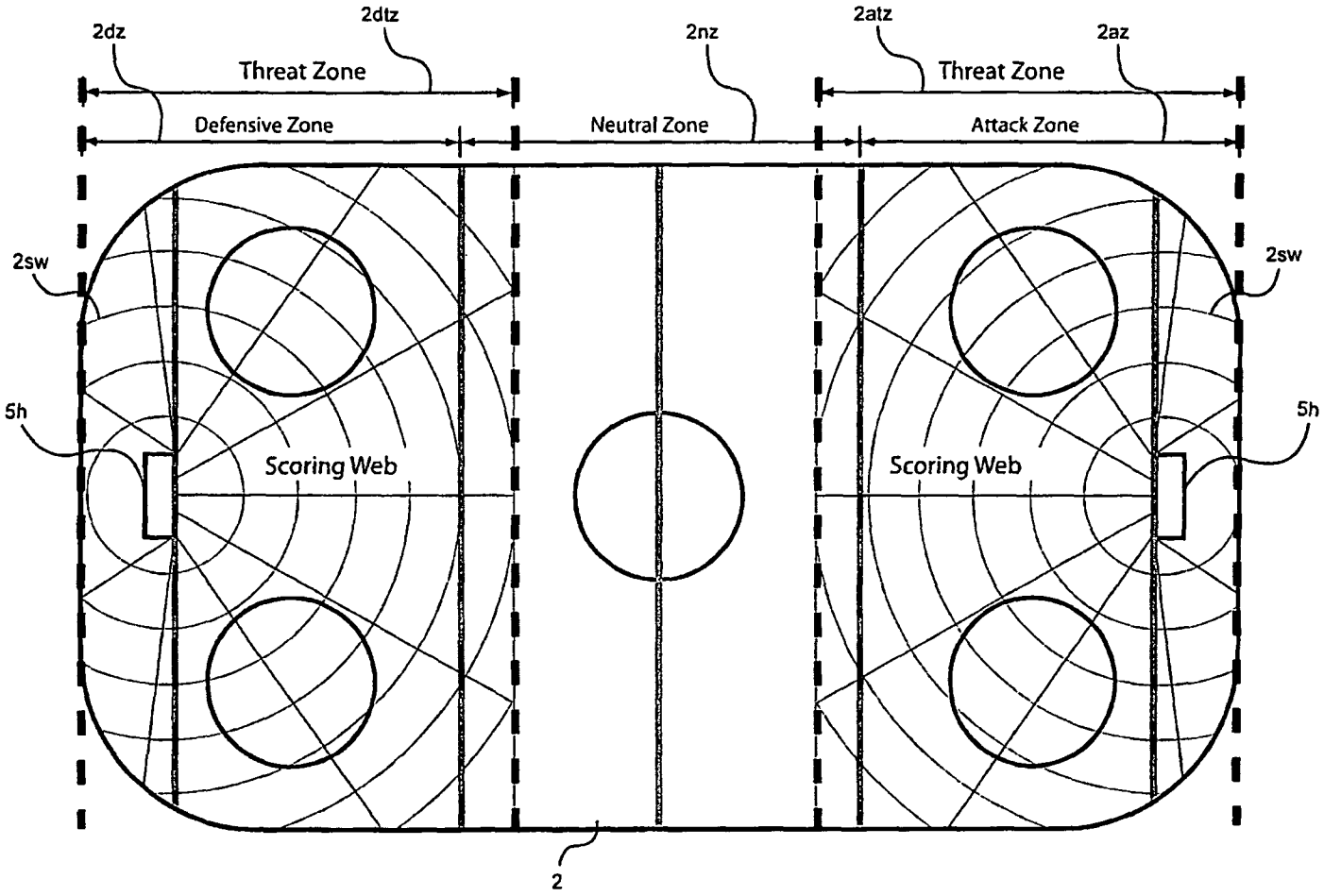
FIG. 10 depicts the tracked predefined area, in this case a hockey rink, where the normally divided regions such as the defensive, neutral and attack zones are further sub-divided into standardized sub-units forming a scoring web. The use of a scoring web to parse data allows for the creation of statistics to be accumulated in association with these finer sub-units for later meaningful comparison.

Referring next to FIG. 10, there is shown the present inventors preferred method for graphically relating portions of the detailed information inherently contained within minimum data 100 and especially within parsed datasets described in FIG. 1, FIG. 3, FIG. 4*a*, FIG. 4*b*, FIG. 13 and FIG. 14. Specifically for ice hockey, at least some sections of the playing area 2 such as defensive zone 2*dz* and offensive zone 2*az* of ice surface 2 may be broken into standard sub areas, or cells, defined for instance by scoring web 2*sw*. The present inventor anticipates that by using the scoring web 2*sw* (or any equivalent sub division arrangement) as portrayed in FIG. 10 for relating detailed textual information in a more readily consumable visual configuration, it will be easier for the consumer of this data to for instance recognize important patterns and value within at least the data sets 100, 200, 300, where data set 200 is further recognized as data 150 through 185 shown in FIG. 4*b*. This same reasoning extends to the types of summary data shown in upcoming FIG. 13 and FIG. 14.

As the amount of statistical information conforming to the teachings of the present inventions are collected for any given sport and any given or all possible competition levels, the use of concepts such as the scoring web 2*sw* provide a effective means for quick comparison between individual games, teams and players over time. This use of this web 2*sw* is further discussed below with respect to FIG. 11.

Figure 11:
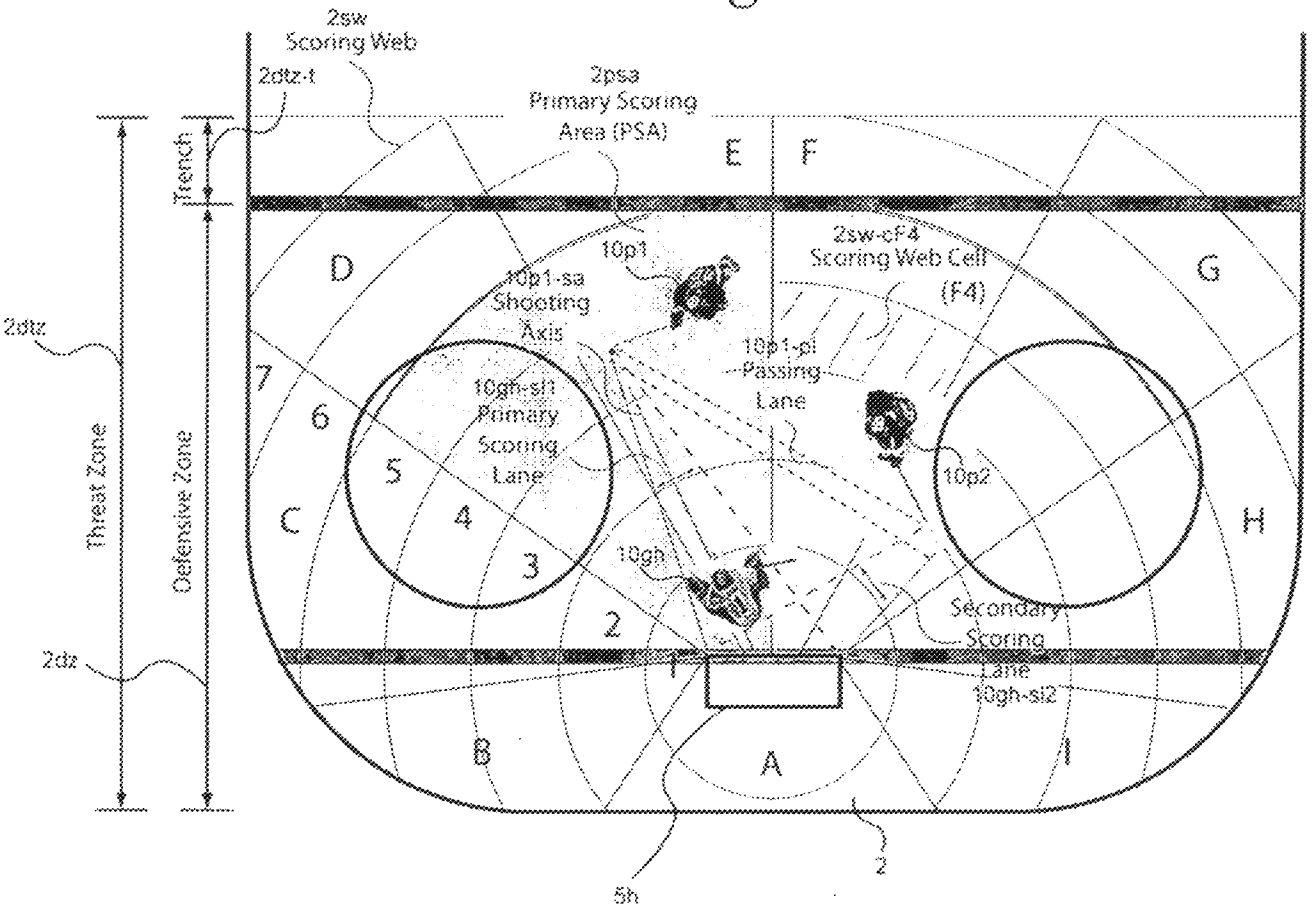
FIG. 11 depicts a portion of the tracked predefined area, in this case the home team's defensive zone, where the sub-units of the scoring web have been coded and where lanes have been defined representing the potential path of the game object between players and between players and the goal.

Now referring to FIG. 11, an in the context of ice hockey, a single zone such as defensive zone 2*dz* might first be extended to include trench area 2*dtz-t* forming threat zone 2*dtz* covered by scoring web 2*sw*. Scoring web 2*sw* further comprises individual cells formed by the overlap of concentric circles 1 through 7 preferably centered around and emanating from goal area 5*h*, along with the sections A through I radiating orthogonal to these circles but also emanating from goal area 5*h*. Also depicted is the concept of classifying some subset of these cells as the "primary scoring area" 2*psa*, already familiar in concept at least to the sport of ice hockey. Given such a scoring web 2*sw*, it is easily understandable by those familiar with data representation, that important statistical information can be displayed within web 2*sw* thus revealing patterns for all intensive purposes not otherwise recognizable by the human consumer. For instance, shots taken and goals scored are a most obvious statistic where cell locations add relevant meaning. Using this approach, it is likely that the chances of scoring on any individual team, goalie-defensive pairing, and goalie himself will tend to differentiate. It is most certain that the scoring web 2*sw* revealed shot-to-goal data across teams competing at different levels of play will be significantly different. Hence, the effective scoring cells for a younger less experienced level of competition will be much narrower that that of a higher level. This will reveal itself as a reduction in the effective primary scoring area 2*psa*, thus supporting the idea of an automatic determination of the actual PSA for a team versus the sport-wide accepted norm. The present inventor anticipates that other statistics novel to the present invention will also be further enhanced by their presentation via the scoring web 2*sw*: one such example being possession time by both team and player. By showing time of possession recast as area of possession with duration time within the scoring cells, coaches and analysts can use the information to judge individual player and team effectiveness at controlling the more valuable playing areas leading to extending threats and ultimately scoring. Conversely, this information graphically reveals the effectiveness of various defensive strategies and team play that are inherently designed to limit possession area and time to those cells of the lowest scoring potential. As will be understood by those skilled in the art of both sports and data representation, many conceivable combinations of data are enhanced by their presentation within the scoring web 2*sw*. Furthermore, the present inventor provides the web 2*sw* as depicted in FIG. 10 and FIG. 11 merely as an example of concept. It is obvious that many other configurations are possible, while the present inventor prefers that the web be at least concentric to and emanating from the scoring area 5*h*.

However, the present inventor also anticipates that in sports such as American football, the scoring web might best be reversed such that it emanates and is concentric to either the quarterback or his "pocket" area where most of his offensive plays are conducted. This reversal of perspective also implies that for American football the scoring web itself continually moves to adjust its setting to the current location of the "pocket" on a play-by-play basis. While the scoring web would move play-by-play, the statistics would all be made relative to this "pocket" based emanation point therefore being most similar to the ice hockey example centered about static goal 5*h*.

Also depicted in FIG. 11 are the concepts of dynamically determining important alignments and pathways such as the shooting axis 10*p*1-*sa* connecting the current location of the puck 3, currently in possession of an opposing player such as 10*p*1, with the center of the scoring area 5*h*. Shooting axis

10*p*1-*sa* is also expandable to the primary scoring lane 10*gh*-*sl*1 within which, for example, goaltender 10*gh* must adequately square and align himself in order to maximize his average effectiveness. Also portrayed is passing lane 10*p*1-*pl* that connects the puck 3 in possession for instance of player 10*p* to that of the reasonable catching area associated with the stick 4 of player 10*p*2. This lane is the most likely area of successful transfer of the puck 3 between teammates 10*p*1 and 10*p*2 and represents a means of creating a secondary scoring lane 10*gh*-*sl*2 with perhaps a higher scoring potential mostly dependent upon goalie 10*gh*'s ability to transfer his position to the new lane 10*gh*-*sl*2 within the time the puck transfer's between players 10*p*1 and 10*p*2.

What is important is that all of this information is only determinable by understanding at least the states of puck 3 (game object) "free" and "possession," which themselves rely solely upon minimum data 100—all as taught herein. Furthermore, the present inventor's claims to novelty with respect to the concept of a scoring web 2*sw* at least extend to any forms of data determinable based upon the combination of data sets 100, 200 and 300 as well as summary information depicted in FIG. 1, FIG. 13 and FIG. 14. Other variations of data measurements for ice hockey beyond those herein described are possible, and this is certainly true for sports other than ice hockey which are not being used as representative examples. Regardless of the sport or the specific statistic or performance measurements, if it has any relation to playing area then it may also benefit by the differentiation and graphical representation within the scoring web 2*sw* without departing from the teachings herein.

Figure 12:
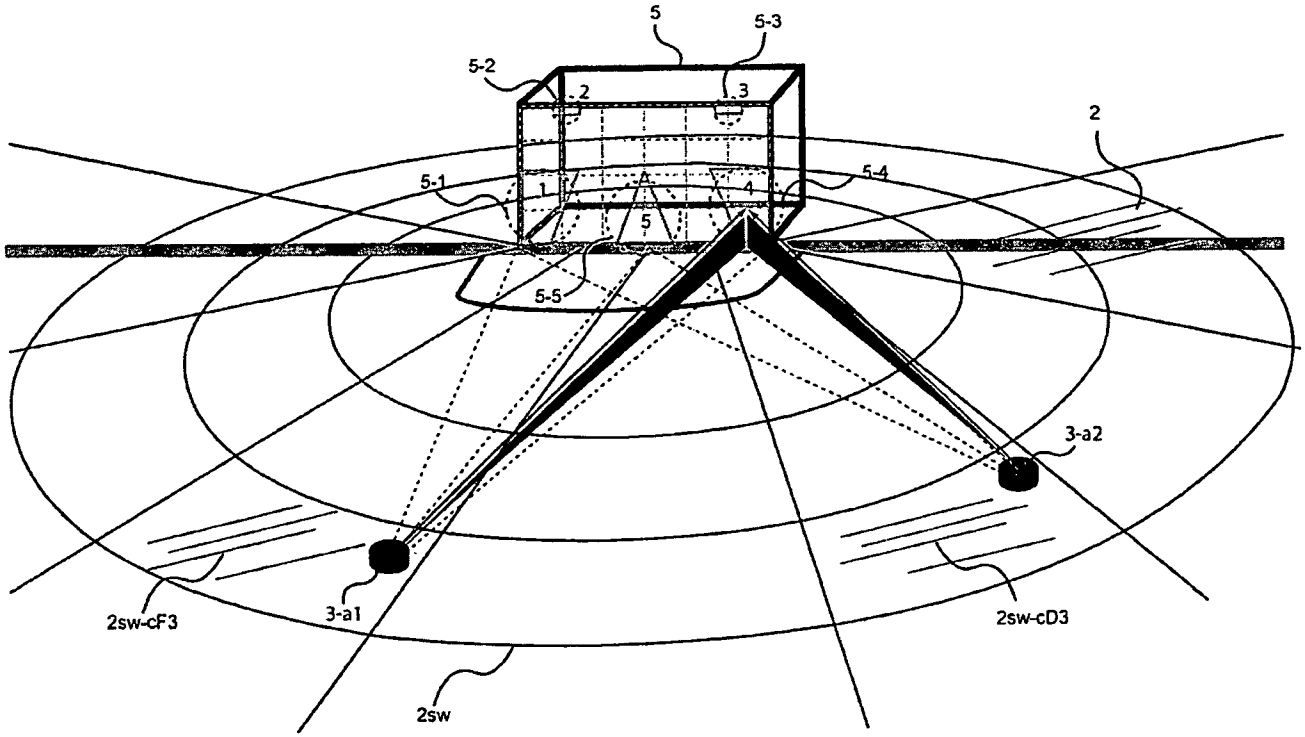
FIG. 12 is a perspective depiction of an ice hockey goal in relation to a puck somewhere outside of the goal showing possible preferred angles of shot towards the goal such that the end location of the shot is one of a set of five preferred goal areas typically assumed to be the least defensible by the guarding goalie. Similar to the manner for breaking down the tracking area into an additional scoring web, the goal (in this case the opening of the net) is also broken into sub-units that may be used to create more meaningful statistics.

Referring next to FIG. 12, the concept of the scoring web 2*sw* is extended to cover the goal scoring area that is unique to wide opening goal net 5 sports such as ice hockey and soccer. The scoring target of goal net 5 is typically thought of as having specific regions of higher scoring possibilities fundamentally related to the correct positioning of the goaltender 10*gh*. These areas are referred to as "holes" 1 through 5 and are correspondingly depicted as shaded areas that are easily contained and approximated by circles 5-1 through 5-5. While the present inventor prefers using overhead tracking system 400 to determine the three dimensional location and trajectory of puck 3, other systems such as the system from Fox Sports also provide this information. Using the information in combination with the known identity and location of the player 10 taking any given shot, along with the inherent understanding that this play is "in possession" as herein taught, it is possible to create shot and goal statistics that are much more comprehensive than the existing practices. Furthermore, as taught with respect to the scoring web 2*ws*, this data has a location component that makes it ideal for presentation in a vertical representation as proposed herein. While some work has been done in this area for the presentation of shot data across various sports, the present inventor extends these practices by the concept of forming individual sub-scoring lanes constructed by connecting the current position of the game object, e.g. the puck 3-*a*1 or 3-*a*2 to any given scoring hole, such as 5-1 or 5-4—thus forming an easily calculated scoring cone, as will be understood by those familiar with mathematics and three dimensional object tracking. Each scoring hole may therefore carry a measurably different and objectively verified scoring chance percent based upon the scoring web 2*sw* cell. Therefore, each cell-scoring hole combination for a given level of competition will carry its own relative scoring chance percent which then serves as an ideal basis for presenting variations to the norm given specific teams, goal-defense pairings and simply goalies themselves.

Referring next to FIG. 13 and FIG. 14, the present inventor provides a list of anticipated statistics and measurements that are all determinable using the minimum necessary and sufficient data 100, especially as translated first via the determination of the states of game object possession, into the data sets of possession flow 200 include gaining control events 210, exchanging control events 220 and relinquishing control events 230 as will be understood by those skilled in the art of information sciences. Of these statistics, all but hits, distance traveled and team speed (when they simply relate to players and the game object regardless of possession,) require the ability to track the states of puck (i.e. game object) transition at least from "free" to "in possession."

Furthermore, if distance traveled and team speed are to also be broken into separate totals for "while in possession" versus "while not in possession," then the teachings herein are critical. While other statistics are certainly possible and are anticipated by the present inventor, what is important is that most relevant statistics based upon prevailing market perceptions, such as those provided in FIG. 1, FIG. 13 and FIG. 14, require the knowledge inherent in possession flow 200.

Possession flow 200 has heretofore only been determinable through subjective means such as having special statisticians carefully watch a given game in order to tally this data—understandably with much less detail, precision and accuracy. As will be understood by those familiar with real-time automatic data collection systems, determining this same information using sensing machines offers significant additional value, typically including objective veracity as well as significantly increased spatial and temporal detail.

As will also be understood by those skilled in the art of object tracking systems, information systems, and the various sports, there are some statistics represented in FIG. 1, FIG. 13 and FIG. 14, or that can be imaged, that do not required knowing the possession state of the game object. Present examples would include ice time, penalty minutes, hits, distance traveled (totals only,) team speed (totals only,) checking (a variation of hits,) line changes, short handed, power plays, defensive zone play and space control. The methods for determining some of these statistics, for instance penalty minutes as well as short handed and power play durations in total and by player, could simply be to receive official game data, ideally in synchronicity with all other real-time object tracking information, something taught by the present inventor in the referenced applications. The formulation of others of these statistics are already known because they are simple calculations based upon the current locations and movements of the players 10 or game object/puck 3 not in reference to possession (for instance distance traveled, team speed and hits.) And still yet the formulation of the remaining aforementioned statistics will be obvious to those skilled in the art. Thus, it is shown that by having available official game data as taught by the present inventor in referenced applications in combination with the minimum necessary and sufficient data 100, it is now possible using the methods herein taught to create the entire set of desirable game statistics beyond those obviously created from data 100, to now also include those dependent upon objectively determining the events 210, 220 and 230 of possession flow 200.

To reiterate and stress earlier points made, the present invention is of utmost importance because it teaches how to take information from machines that currently exists to automatically combine into new types of meta-data revolving around the concept of possession. It is important to note again that there are already working machines and systems, such as those from Trakus using active beacons that have already demonstrated that the continuous player 10 location and identity may be tracked—which is data 124. However, a careful study of the uses envisioned and promoted by Trakus and users of its system only included the less relevant statistics of player speeds, distances traveled and perhaps player collision force measurements—all of which have proven to have minimal value to the market. Other working systems like that sold by Fox Sports have demonstrated how the game object (at least a hockey puck 3) could be tracked in three dimensions (which is data 126) but were simply employed as a means of either creating graphic enhancements to the puck 3 image within the video stream of the sports broadcast or were anticipated to be used for automatically directing the moving of videoing cameras. Similar to the fate of the Trakus system, the marketplace appears to have rejected the enhancement of the puck's travel path and the automatic movement of cameras itself provided too little additional value to support the use of this technology.

While other systems have been proposed and are currently the subjects of both research and patents, these systems tend to be focused on collecting the same types of information already being produced by both Trakus and Fox Sports, only with presumably more acceptable base technologies. However, the fundamental problem from the present inventor's perspective is misunderstood and transcends the actual means for collecting each of the necessary and sufficient continuously changing data sets 124 and 126. What is needed and is herein taught is a way of taking this voluminous and seemingly random information and parsing it through a set of rigidly determinable and repeatable steps into high level and useful meta-information. Doing this requires a set of methods steps such as disclosed herein by the present inventor and goes beyond the mere collection of the datasets, as has been proven defacto since the data sets have existed in practice for some time (at least for ice hockey) without the herein taught automatically generated meta-data. It is the teaching of the present inventor that what is needed more than necessarily another way to collect data sets 124 and 126, is a process by which this data can be made significantly meaningful to support its cost of collection.

The transition to meaningful information specifically requires the incremental buildup of meta-data starting with the transition from the minimum necessary and sufficient data 100 of FIG. 2 to the possession states shown in FIG. 8, directly leading to the possession flow data of FIG. 3 and FIG. 4*a*, all of which is combinable into the market acceptable statistics of FIG. 1, FIG. 13 and FIG. 14. Furthermore, once automatically converted from its less acceptable raw form, data sets 124 and 126 create information that is advantageously presentable via new graphical compositions such as the scoring web 2*sw* taught herein. All of which the present invention enables through its disclosed method steps teaching the build up of information starting with the fundamental understanding of game object "free" verses "in possession"—again directly leading to possession flow 200.

The present inventor teaches an objective and deterministic (as opposed to probabilistic best guesses) set of steps relying upon the minimum set of necessary and sufficient data 100. While various systems have been taught to collect some portions of the necessary and sufficient data defined in set 100, specifically player centroid and identity as well as game object location, the present inventor is not aware of any other inventions or systems available in the market that combine the data in set 100, let alone teach or employ the method steps herein discussed to translate their low level voluminous data into the higher level pertinent information of data sets 100, 200 and 300 as well as that show in FIG. 1, FIG. 13 and FIG. 14.

CONCLUSIONS AND RAMIFICATIONS

Thus the reader will see that the present invention accomplishes its objective of teaching the apparatus and methods for automatically determining ongoing and real-time statistics and performance measurements at least encompassing those currently determined by human observation by translating the continuous input of identified player and game object tracking information as well as official game time-in-out data. The invention has shown specifically how these measurements are the basis for a well defined possession flow cycle that establishes a universally applicable standard, thus supporting the stated objective for having statistics and performance measurements that are comparable across all levels of age and competitive experience within a given sport and even across one or more sports.

While the present inventor prefers to collect player location and identity data as well as game object location data from the overhead tracking system disclosed in the referenced applications, the specification herein clearly discloses methods that are not dependent upon this type of machine vision system, or in fact any one type of tracking system, in order to be useful. Furthermore, the present invention has clearly described that at least for the sport of ice hockey, the minimum and necessary data sets to support the objective and automatic creation of meaningful statistics are already present and available to the marketplace, albeit as separate systems not currently being used in combination. Specifically, the data sets of player location and identity can be achieved using the active beacon system sold by Trakus while the puck's location can be tracked using the system owned by Fox Sports. It should therefore be understood that the actual apparatus for collecting real-time player and game object tracking data are immaterial to the novelty of the current invention and that any future new or different apparatus for collecting this same information falls within the scope of the present teachings.

As will also be understood by those skilled in the arts of various sports and information systems, while the present inventor choose to describe and teach the herein apparatus and methods using the sport of ice hockey as an example, the present invention is not to be limited to ice hockey only, but is at least also applicable to soccer, basketball, football, baseball, lacrosse, tennis, volleyball, squash, etc. What is shared in common with each of these sports is that they:

- are conducted in a predefined area such that knowing the boundaries of this area is important to determining at least the game object's states of "free" and "in possession," both states of which are bounded by the physical area of play;
- take place during a predefined sequence of time, the sequence of which is often punctuated by breaks in game play such that knowing when the game play time is "in" versus "out" is important to determining at least the game object's states of "free" and "in possession," both states of which are bounded by the actual time-in of play;
- have at least two opposing players who each move about within the playing area with respect to both the area and each other, the continuous locations and identity of which are both important to determining at least the game object's states of "free" and "in possession," both states of which are inherently associated to the players, and
- have one game object being contested for by the opposing players, the continuous locations of which is important to determining at least the game object's states of "free"

and "in possession," both states of which are inherently associated to these game object itself.

From this understanding it has been shown that the minimum necessary and sufficient data for determining at least the game object states of "free" and "in possession" include:

the predefined layout of the at least the playing field, thus defining the tracking area;

the continuously changing data of the official game time thus exactly defining "time-in" play versus "time-out";

the continuously changing data of the current X, Y centroid location of each player with respect to the tracking area, along with their identity, and the continuously changing data of the current X, Y centroid location of the game object also with respect to the tracking area.

The present invention has taught at least one set of method steps that is readily implemented via computer processing for parsing this highly detailed set of minimum necessary and sufficient data into the more meaningful set of possession flow information, fundamentally reliant upon the ability to determine at least the game object's "free" versus its "in-possession" state. The present invention has shown how these fundamental game object state transitions, which may also readily include the states of "in contention" and "under challenge," may themselves be translated into the unique events of possession flow covering gaining control, exchanging control and relinquishing control of the game object by a single team (or individual in a non-team sport.)

The present invention also taught the basic method steps for determining possession based upon the distance between player and game object, the minimum radius surrounding the player in which the game object must reside to possibly be in their possession, and the minimum time the game object must remain within the minimum radius before assignment is awarded.

In addition to this first set of method steps, advantageous variations were taught that include using average distance over time rather than instantaneous distance. This variation helps to compensate for the dribbling forward effect of certain sports such as ice hockey and soccer where a player may remain in control while for a time they have pushed the game object on in front of them in their direct path of travel, where it has gone beyond the minimum radius for possession. Also discussed are the steps for dynamically setting the minimum time the game object must remain in a player's sphere of influence before possession is assigned to that player. This dynamic calculation was taught to be variable based upon not just the game object's velocity but also its trajectory as well as the velocity and trajectory of the player for which possible possession is being considered.

The present inventor then taught how trajectory and acceleration, calculable from a minimum consideration of three data points, may be used to effectively shorten the minimum time necessary to assign possession to a given player by essentially detecting a alteration in the trajectory or acceleration of the game object after it enters the player's sphere of influence, that exceeds some minimum threshold. Furthermore, the present inventor has taught at least one of the values of having the additional information of player orientation, something the preferred overhead tracking system accomplishes especially for indoor sports that an RF based beacon system cannot. Having this orientation information was shown to be helpful for reducing the maximum sphere of player influence from the simplest calculation of a circle of distance MinR surrounding the player's centroid to a sector of this same circle, now bounded by some reasonable arc roughly centered about the player's determined forward orientation. Such information helps to rule out possession for situations where the game object might reside within the maximum sphere for the minimum time to assign possession but might also be directly behind the player and therefore reasonably not within their control.

The present inventor has also taught in applications that are referenced to this application how the official game time-in and time-out may be either directly received from the console device controlling the typical game scoreboard or may alternatively be detected using machine vision to continuously analyze the scoreboard face during game play in order to parse its emitted light energy back into the digital characters they represent.

Thus the reader will see that the present invention successfully teaches how higher level and more meaningful statistics can be deterministically and automatically derived from continuous low level information streams heretofore only perceived as useful for a limited set of less meaningful statistics such as player speed, distance travel and collision force.

From the foregoing detailed description of the present invention, it will be apparent that the invention has a number of advantages, some of which have been described herein and others of which are inherent to the invention. Also, it will be apparent that modifications can be made to the present invention without departing from the teachings of the invention. Accordingly, the scope of the invention is only to be limited as necessitated by the accompanying claims.

What is claimed is:

1. A system for use in sporting events for automatically determining the game object, player, and team states of in-possession, comprising:

a system for tracking on-going locations of each player matched to their identification data, where the identification data at least include either or both of the player's identity or team if the sporting event is a team sport;

a system for tracking the on-going locations of the game object, and a state tracking computer for receiving the on-going player locations and related identification data along with the on-going game object locations, and for determining if the game object is in a state of in-possession for each instant of received data, where the determination is made by comparing the various player locations, or any information derived from the on-going player locations at least including velocity, acceleration and trajectory, with the location of the game object, or any information derived from the on-going game object location at least including velocity, acceleration and trajectory, such that the comparison assigns the game object to a state of in-possession of a player, where the state tracking computer additionally tracks team possession, where possession is initially assigned to a team when: 1) the given team is not currently assigned possession, and 2) any one of the given team's players are assigned possession, and for removing the assignment of possession from a team when possession is no longer assigned to any player on the given team, and where the state tracking computer further designates and tracks the team events of 1) gain control, 2) exchange control and 3) relinquish control, where:

a gain control event (1) is only created for a given team if either: (a) the sequence of game object states was determined of in-possession followed by under-contention followed by in-possession, wherein the player assigned to the preceding in-possession is not a member of the given team and a different player assigned to the subsequent in-possession is a member of the given team, or (b)

the sequence of game object states was determined of in-possession followed by free followed by in-possession, where the player assigned to the preceding in-possession is not a member of the given team and a different player assigned to the subsequent in-possession is a member of the given team;

an exchange control event (2) is only created for a given team if the sequence of game object states was determined of in-possession followed by free followed by in-possession, where the player assigned to the preceding in-possession is a member of the given team and a different player assigned to the subsequent in-possession is also a member of the given team, and a relinquish control event (3) is only created for a given team if either: (a) the sequence of game object states was determined of in-possession followed by under-contention followed by in-possession, wherein the player assigned to the preceding in-possession is a member of the given team and a different player assigned to the subsequent in-possession is not a member of the given team, (b) the sequence of game object states was determined of in-possession followed by free followed by in-possession, where the player assigned to the preceding in-possession is a member of the given team and a different player assigned to the subsequent in-possession is not a member of the given team, or (c) the game object state was determined to be in-possession of a player on the given team when the clock was subsequently determined to be not running.

2. The system of claim 1 where the state tracking computer is further adapted to receive or determine geometric information regarding the event playing area corresponding to the possible on-going locations of the game objects and players, where this information either corresponds directly to regions of the playing area that are visible to the players and spectators, or represents abstract sub-units that are not visually evident, and where the state tracking computer is further adapted to record any and all regions or sub-units where a game object, player, or team event state change occurs, or duration between state changes takes place within, and associates this recorded statistical information with any combination of the object, player, team event, region or sub-unit.

3. The system of claim 2, at least for the sport of ice hockey, where the visible regions at least include the defensive, neutral and attack zones, and the abstract sub-units including any one of, or any combination of (1) a scoring web emanating from the goal area; (2) a threat zone located with respect to the defensive zone; (3) a primary scoring area located with respect to the goal; (4) a primary shooting lane and shooting axis located with respect to a player in-possession of the game object and the goal; (5) a secondary shooting lane and shooting axis located with respect to a teammate of a player in-possession of the game object and the goal; (5) a passing lane located with respect to a player in-possession of the game object and a teammate, or a (6) scoring target located vertically with respect to a vertical goal scoring area.

4. The system of claim 3 where shots taken by the opposing players at a team's goal are recorded statistically based on either or both the scoring web, where the origin of the shot defines the cell of the web that is statistically updated, or the goal sub-units, where the destination of the shot defines the sub-unit of the vertical goal area that is statistically updated.

5. The system of claim 1 for additionally correlating captured video of the sporting event with the determined performance measurements, further comprising:

a videoing system for capturing video data of the sporting event concurrently with the operations and determinations of the state tracking computer; and the state tracking computer further adapted to determine and maintain a dataset of performance measurements at least including game object, player, or team event states, and where the performance measurements are correlated in time with the video data.

6. The system of claim 5 where the performance measurements are automatically overlaid onto the video data based upon the correlation between the performance measurements and the video data.

7. The system of claim 1 where either or both the player tracking system or the game object tracking system use any one of, or any combination of: (i) RF transmitters and receivers, (ii) IR transmitters and receivers, or (iii) cameras.

8. The system of claim 1 where the player tracking system and the game object tracking system are a single system for tracking both the players and game object.

9. A method for use in sporting events for automatically determining the game object, player, and team states of in-possession, the method comprising the steps of:

tracking on-going locations of each player matched to their identification data, where the identification data at least include either or both of the player's identity or team if the sporting event is a team sport;

tracking the on-going locations of the game object; and receiving and processing the on-going player locations and related identification data along with the on-going game object locations, where the processing includes determining if the game object is in a state of in-possession for each instant of received data, where the determination is made by comparing the various player locations, or any information derived from the on-going player locations at least including velocity, acceleration and trajectory, with the location of the game object, or any information derived from the on-going game object location at least including velocity, acceleration and trajectory, such that the comparison assigns the game object to a state of in-possession of a player, where the state tracking computer additionally tracks team possession, where possession is initially assigned to a team when: 1) the given team is not currently assigned possession, and 2) any one of the given team's players are assigned possession, and for removing the assignment of possession from a team when possession is no longer assigned to any player on the given team, and where the state tracking computer further designates and tracks the team events of 1) gain control, 2) exchange control and 3) relinquish control, where:

a gain control event (1) is only created for a given team if either: (a) the sequence of game object states was determined of in-possession followed by under-contention followed by in-possession, wherein the player assigned to the preceding in-possession is not a member of the given team and a different player assigned to the subsequent in-possession is a member of the given team, or (b) the sequence of game object states was determined of in-possession followed by free followed by in-possession, where the player assigned to the preceding in-possession is not a member of the given team and a different player assigned to the subsequent in-possession is a member of the given team;

an exchange control event (2) is only created for a given team if the sequence of game object states was determined of in-possession followed by free followed by in-possession, where the player assigned to the preceding in-possession is a member of the given team and a different player assigned to the subsequent in-possession is also a member of the given team, and a relinquish control event (3) is only created for a given team if either: (a) the sequence of game object states was determined of in-possession followed by under-contention followed by in-possession, wherein the player assigned to the preceding in-possession is a member of the given team and a different player assigned to the subsequent in-possession is not a member of the given team, (b) the sequence of game object states was determined of in-possession followed by free followed by in-possession, where the player assigned to the preceding in-possession is a member of the given team and a different player assigned to the subsequent in-possession is not a member of the given team, or (c) the game object state was determined to be in-possession of a player on the given team when the clock was subsequently determined to be not running.

10. The method of claim 9 where the step for receiving and processing the on-going player locations and related identity data along with the on-going game object locations is further adapted to receive or determine geometric information regarding the event playing area corresponding to the possible on-going locations of the game objects and players, where this information either corresponds directly to regions of the playing area that are visible to the players and spectators, or represents abstract sub-units that are not visually evident, and where the state tracking computer is further adapted to record any and all regions or sub-units where a game object, player, or team event state change occurs, or duration between state changes takes place within, and associates this recorded statistical information with any combination of the object, player, team event, region or sub-unit.

11. The method of claim 10, at least for the sport of ice hockey, where the visible regions at least include the defensive, neutral and attack zones, and the abstract sub-units including any one of, or any combination of: (1) a scoring web emanating from the goal area; (2) a threat zone located with respect to the defensive zone; (3) a primary scoring area located with respect to the goal; (4) a primary shooting lane and shooting axis located with respect to a player in-possession of the game object and the goal; (5) a secondary shooting lane and shooting axis located with respect to a teammate of a player in-possession of the game object and the goal; (5) a passing lane located with respect to a player in-possession of the game object and a teammate, or a (6) scoring target located vertically with respect to a vertical goal scoring area.

12. The method of claim 11 where shots taken by the opposing players at a team's goal are recorded statistically based on either or both the scoring web, where the origin of the shot defines the cell of the web that is statistically updated, or the goal sub-units, where the destination of the shot defines the sub-unit of the vertical goal area that is statistically updated.

13. The method of claim 9 for additionally correlating captured video of the sporting event with the determined performance measurements, further comprising the step of:

capturing video data of the sporting event concurrently with the operations and determinations of the state tracking computer, and where the step for receiving and processing the on-going player locations and related identification data along with the on-going game object locations is further adapted to determine and maintain a dataset of performance measurements at least including game object, player, or team event states, and where the performance measurements are correlated in time with the video data.

14. The method of claim 13 where the performance measurements are automatically overlaid onto the video data based upon the correlation between the performance measurements and the video data.

15. The method of claim 9 where either or both the step for player tracking or the step for game object tracking use any one of, or any combination of (i) RF transmitters and receivers, (ii) IR transmitters and receivers, or (iii) cameras.

16. The method of claim 9 where the step for player tracking and the step for game object tracking are a single step for tracking both the players and game object.

* * * * *